US007725047B2

(12) United States Patent
Maeda et al.

(10) Patent No.: US 7,725,047 B2
(45) Date of Patent: May 25, 2010

(54) FIXING APPARATUS AND IMAGE FORMING APPARATUS PROVIDED THEREWITH, COMPUTER-READABLE MEDIUM STORING A CONTROL PROGRAM FOR THE FIXING APPARATUS, AND A CONTACT METHOD FOR AN EXTERNAL HEATING MEMBER IN THE FIXING APPARATUS

(75) Inventors: Tomohiro Maeda, Yao (JP); Toshiaki Kagawa, Nara (JP); Toyoaki Nanba, Higashiosaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 544 days.

(21) Appl. No.: 11/744,237

(22) Filed: May 4, 2007

(65) Prior Publication Data

US 2007/0264059 A1 Nov. 15, 2007

(30) Foreign Application Priority Data

May 12, 2006 (JP) ..... 2006-134429

(51) Int. Cl.
*G03G 15/20* (2006.01)

(52) U.S. Cl. ..... 399/69; 399/327; 399/328

(58) Field of Classification Search ..... 399/67, 399/320, 327, 328, 69; 219/216
See application file for complete search history.

(56) References Cited

U.S. PATENT DOCUMENTS 6,411,785 B1 6/2002 Ogawahara et al.
7,058,329 B2 * 6/2006 Takahashi ..... 399/69
2005/0117942 A1 6/2005 Ishii et al.
2005/0141936 A1 6/2005 Kawashima
2005/0214043 A1 * 9/2005 Kameda ..... 399/328
2006/0245796 A1 * 11/2006 Wu et al. ..... 399/328
2008/0044210 A1 2/2008 Kawashima
2008/0080911 A1 4/2008 Ishii et al.

FOREIGN PATENT DOCUMENTS

| | | |
|---|---|---|
| CN | 1298127 | 6/2001 |
| CN | 1621961 | 6/2005 |
| JP | 52-017031 | 2/1977 |
| JP | 11-038802 | 2/1999 |
| JP | 2005-189427 | 7/2005 |
| JP | 2005-292714 | 10/2005 |

* cited by examiner

*Primary Examiner*—David P Porta
*Assistant Examiner*—Milton Gonzalez
(74) *Attorney, Agent, or Firm*—Renner, Otto, Boisselle & Sklar, LLP

(57) ABSTRACT

A fixing apparatus including: a fixing roller, pressed against a printing paper at a fixing nip area, for fixing toner on the printing paper, and transporting the printing paper by undergoing rotation; an external heating section for heating a surface of the fixing roller by being brought into contact therewith; a release/contact operating section for causing the external heating section to be brought into contact with or separated from the fixing roller; and a cleaning section for cleaning the surface of the fixing roller. The release/contact operating section brings the external heating section into contact with the fixing roller at such a timing that a portion of fixing roller initially in contact with the external heating section does not make contact with the printing paper at the fixing nip area in one rotation of the fixing roller.

14 Claims, 12 Drawing Sheets

FIG. 9

SAME TRANSPORT SPEED FOR COLOR AND MONOCHROMATIC IMAGES

| FIXING TEMPERATURE | COLOR | MONOCHROMATIC |
|---|---|---|
| 220°C | H | H |
| 210°C | H | H |
| 200°C | H | ○ |
| 190°C | ○ | ○ |
| 180°C | ○ | ○ |
| 170°C | ○ | ○ |
| 160°C | ○ | ○ |
| 150°C | C | C |

H: HOT OFFSET
C: COLD OFFSET
○: DESIRABLE FIXING

COMMON NON-OFFSET RANGE

FIG. 10

TRANSPORT SPEED FOR COLOR IMAGE 170 mm/s
TRANSPORT SPEED FOR MONOCHROMATIC IMAGE 350 mm/s

| FIXING TEMPERATURE | COLOR | MONOCHROMATIC |
|---|---|---|
| 220°C | H | H |
| 210°C | H | ○ |
| 200°C | H | ○ |
| 190°C | ○ | ○ |
| 180°C | ○ | ○ |
| 170°C | ○ | C |
| 160°C | ○ | C |
| 150°C | C | C |

H: HOT OFFSET
C: COLD OFFSET
○: DESIRABLE FIXING

COMMON NON-OFFSET RANGE

FIXING APPARATUS AND IMAGE FORMING APPARATUS PROVIDED THEREWITH, COMPUTER-READABLE MEDIUM STORING A CONTROL PROGRAM FOR THE FIXING APPARATUS, AND A CONTACT METHOD FOR AN EXTERNAL HEATING MEMBER IN THE FIXING APPARATUS

This Nonprovisional application claims priority under 35 U.S.C. §119(a) on Patent Application No. 134429/2006 filed in Japan on May 12, 2006, the entire contents of which are hereby incorporated by reference.

FIELD OF THE INVENTION

The present invention relates to a fixing apparatus that fixes an unfixed toner image on printing paper with heat and pressure, in image forming apparatuses such as copying machines, printers, and facsimile machines.

BACKGROUND OF THE INVENTION

Electrophotographic image forming apparatuses (for example, printers) include a fixing apparatus by which a toner image formed on printing paper is fused with heat and fixed thereon. As an example of such a fixing apparatus, there has been known a fixing apparatus of a roller pair system, in which a fixing roller and a pressure roller are provided, as described in Publications 1 to 4 below.

The fixing roller is a roller member with a hollow core of metal such as aluminum, whose surface is coated with an elastic layer and inside which is installed a halogen lamp as a heat source. The temperature of the fixing roller is controlled by a temperature control section, which controls ON/OFF of the halogen lamp based on a signal outputted from a temperature sensor provided on the surface of the fixing roller.

The halogen lamp is just one example of a means for heating the fixing roller. There has also been known an external heating member which is pressed against the surface of the fixing roller to heat the fixing roller. Specific examples of such an external heating member include an external heating roller disclosed in Publication 1, and external heating belts disclosed in Publications 2 through 4. Since the external heating member is directly in contact with the surface of the fixing roller, the external heating member can heat the surface of the fixing roller more quickly than the halogen lamp.

The pressure roller is a roller member with a metal core covered with a heat-resistant elastic layer, which is made of silicone rubber for example. The pressure roller is pressed against the surface of the fixing roller, which causes the pressure roller to undergo elastic deformation. As a result, a nip region is formed between the fixing roller and the pressure roller.

In the fixing apparatus having the foregoing arrangement, a printing paper with an unfixed toner image thereon is sent to the nip region between the fixing roller and the pressure roller, and the printing paper is transported by rotating the fixing roller and the pressure roller. The toner image on the printing paper is then fused with the transferred heat from the surface of the fixing roller. This fixes the toner image on the printing paper.

In such a fixing apparatus, offset phenomena such as cold offset and hot offset are known to occur when the surface temperature of the fixing roller falls outside of a suitable temperature range. The cold offset is a phenomenon in which some of the toner that did not melt property due to shortage of transferred heat to the printing paper adheres to the fixing roller. The hot offset is a phenomenon in which some of the toner on the printing paper adheres to the fixing roller due to weakened toner cohesive force caused by overheating of the toner on the printing paper.

In order to prevent cold offset and hot offset, it is very important in the fixing apparatus to control surface temperature of the fixing roller within a suitable temperature range during feeding of printing paper.

A suitable temperature range for the surface temperature of the fixing roller varies depending upon a printing paper transport speed of an image forming apparatus in which the fixing apparatus is installed. More specifically, a suitable temperature range tends to shift to higher temperatures with increase in transport speed (process speed) of printing paper, and to lower temperatures with decrease in transport speed of printing paper. The reason for this is that a fast transport speed affords only a short contact time for the printing paper and the surface of the fixing roller, and as such a relatively high surface temperature is required for the fixing roller in order to transfer a sufficient amount of heat to the printing paper. When the transport speed is slow, there is a long contact time for the printing paper and the surface of the fixing roller. In this case, the transfer of heat from the surface of the fixing roller to the printing paper will be in excess unless the surface temperature of the fixing roller is restrained.

A so-called four-cycle electrophotographic image forming apparatus is generally designed to have substantially the same printing paper transport speed for color and monochromatic images formed on printing paper. (It is noted however that the distance between transported sheets of printing paper is different between color mode and monochromatic mode, and as such the number of sheets processed per unit time is greater in the monochromatic mode.) A four-cycle electrophotographic image forming apparatus forms color images from overlaid toner images of four colors C, M, Y, K, which are formed by a set of visualized image forming units.

In a fixing apparatus for the four-cycle electrophotographic image forming apparatus, there is a sufficiently wide common non-offset range in the suitable temperature ranges (non-offset ranges) for fixing color images and monochromatic images, as shown in FIG. 9 (common non-offset range being an overlapping range of these non-offset ranges). It is therefore easy to set a control value (target value) for the surface temperature of the fixing roller within the common non-offset range, and control the surface temperature of the fixing roller within suitable temperature ranges in fixing both color and monochromatic images. In this manner, the offset phenomenon can easily be avoided in the four-cycle image forming apparatus.

Meanwhile, there is a new type of image forming apparatus employing a four-drum tandem engine, provided with four sets of visualized image forming units respectively corresponding to colors of C, M, Y, and K. In this type of image forming apparatus, there is an increasing demand for providing a faster printing paper transport speed for monochromatic images than for color images. In this design, there is a large difference in printing paper transport speed between a monochromatic mode forming monochromatic images and a color mode forming color images. The number of sheets processed per unit time in the monochromatic mode can also be increased in this manner, without causing deterioration of image quality in resulting monochromatic images.

However, in the image forming apparatus that employs such design to increase the number of processed sheets for monochromatic images, there is a significantly narrow common non-offset range in the non-offset ranges for fixing color and monochromatic images, as shown in FIG. 10. With such a narrow common non-offset range, it is difficult to control the surface temperature of the fixing roller within the common non-offset range even when a control value (target value) for the surface temperature of the fixing roller is set within the common non-offset range. This easily causes the problem of cold offset and hot offset.

Further, for feeding from standby, the surface temperature of the fixing roller needs to be set to enable feeding both in the monochromatic mode and the color mode. Thus, during standby, the surface temperature of the fixing roller needs to be controlled between a lower limit of fixing temperature for the monochromatic mode and an upper limit of fixing temperature for the color mode, and be ready for quick switching between the monochromatic mode and the color mode in subsequent feeding operations.

For accurate control of the surface temperature of the fixing roller in a fixing apparatus adapted for color images, an external heating member such as an external heating roller or an external heating belt that is brought into contact with the surface of the fixing roller is more suitable compared with an internal heating member such as a halogen lamp provided inside the fixing roller. In this respect, temperature control by the external heating member is important for controlling the surface temperature of the fixing roller within a narrow temperature range.

In one method of temperature control by the external heating member, the release/contact of the external heating member is controlled based on information indicative of surface temperature of the fixing roller, so as to instantly raise or lower the surface temperature of the fixing roller. The surface of the fixing roller can be controlled at a predetermined temperature by bringing the external heating member into contact with the fixing roller or separating it therefrom according to the print mode. Specifically, according to the print mode, the external heating member is brought into contact with the fixing roller to increase the surface temperature of the fixing roller, or separated therefrom to prevent overheating of the fixing member.

[Publication 1]

Japanese Unexamined Patent Publication No. 038802/1999 (Tokukaihei 11-038802; published on Feb. 12, 1999)

[Publication 2]

Japanese Unexamined Patent Publication No. 189427/2005 (Tokukai 2005-189427; published on Jul. 14, 2005)

[Publication 3]

Japanese Unexamined Patent Publication No. 292714/2005 (Tokukai 2005-292714; published on Oct. 20, 2005)

[Publication 4]

Japanese Unexamined Patent Publication No. 017031/1977 (Tokukaisho 52-017031; published on Feb. 8, 1977)

SUMMARY OF THE INVENTION

The inventors of the present invention have found problems in the release/contact operation of the external heating member.

Under a heavy load of print process, toner that has slightly offset during the print process adheres to the surface of the fixing roller. In order to prevent contamination caused by toner or paper dust, a fixing roller equipped with the external heating member is generally provided with cleaning means, such as a cleaning web, on the upstream side of the external heating member in a direction of rotation of the fixing roller.

The cleaning means removes most of the toner that has adhered to the fixing roller, solving much of the toner contamination on the external heating member. However, since the cleaning capability of the cleaning means is not perfect, toner contamination accumulates over time on the external heating member.

As the toner accumulates on the external heating member, the toner may be detached from the external heating member in clusters and transferred onto the fixing roller by the force of impact, when the external heating member is made contact with the fixing member. When there is transfer of some toner from the external heating member to the surface of the fixing roller, the toner on the fixing roller adheres to the printing paper during feeding, with the result that the print face is contaminated.

More specifically, when the external heating member (FIG. 11) not in contact with the fixing roller is brought into contact with the fixing roller (FIG. 12), the toner adhering to a belt surface of the external heating member at an initial contact point is transferred to the surface of the fixing roller, and the toner so transferred to the fixing roller is transported to the nip area by the rotation of the fixing roller (FIG. 13). The toner at the nip area is then adheres to the printing paper that has been fed thereto (FIG. 14), with the result that the printing paper is contaminated.

The present invention was made in view of the foregoing problems, and an object of the invention is to prevent contamination of a printing medium such as printing paper caused by toner or developer that has been transferred from an external member to a fixing member such as a fixing roller, in a fixing apparatus in which the external heating member is installed.

In order to achieve the foregoing object, a fixing apparatus according to the present invention includes: a fixing member, pressed against a printing medium at a nip area, for fixing a developer on the printing medium, and transporting the printing medium by undergoing rotation; an external heating member for heating a surface of the fixing member by being brought into contact therewith; a release/contact operating section for causing the external heating member to be brought into contact with or separated from the fixing member; a cleaning section for removing the developer from the surface of the fixing member; and a control section for controlling the release/contact operating section, so as to bring the external heating member into contact with the fixing member at such a timing that a portion of the fixing member initially in contact with the external heating member does not make contact with the printing medium in one rotation of the fixing member.

In a fixing apparatus according to the present invention, a developer on a printing medium of fixed thereon by the fixing member. By the provision of the cleaning section that removes a developer adhered to the surface of the fixing member, the fixing apparatus is able to clean the surface of the fixing member. Further, by the provision of the external heating member that heats the surface of the fixing member by being brought into contact therewith, the fixing apparatus is able to quickly heat the surface of the fixing member. Further, by the provision of the release/contact operating section that causes the external heating member to be brought contact with the fixing member or separated therefrom, the fixing apparatus is able to suitably adjust the surface temperature of the fixing member without overheating the surface of the fixing member.

According to the foregoing arrangement, under the control of the control section, the release/contact operating section brings the external heating member into contact with the fixing member at such a timing that the initial contact portion does not make contact with the printing medium in one rotation of the fixing member. There accordingly will be no contamination of the printing medium by the developer in one rotation of the fixing member. The developer that has been transferred from the external heating member to the surface of the fixing member is removed by the cleaning section in one rotation of the fixing member. As such, there will be no subsequent contamination of the printing medium. In sum, the printing medium is prevented from being contaminated by the developer that has been transferred from the external heating member to the fixing member.

The control section may be realized by hardware, or by executing a program by a computer. Specifically, a control program according to the present invention causes a computer to operate as the control section, and a storage medium according to the present invention stores therein the control program.

With the program executed by the computer, the computer operates as the control section of the fixing apparatus. Thus, as in the case of the fixing apparatus, the printing medium is prevented from being contaminated by the developer that has been transferred from the external heating member to the fixing member.

According to the present invention, there is provided a method for causing an external heating member to be brought into contact with a fixing member in a fixing apparatus that includes: a fixing member, pressed against a printing medium at a nip area, for fixing a developer on the printing medium, and transporting the printing medium by undergoing rotation; an external heating member for heating a surface of the fixing member by being brought into contact therewith; and a cleaning section for removing the developer from the surface of the fixing member, the method including bringing the external heating member into contact with the fixing member at such a timing that a portion of the fixing member initially in contact with the external heating member does not make contact with the printing medium in one rotation of the fixing member.

According to the foregoing method, the printing medium is prevented from being contaminated by the developer that has been transferred from the external heating member to the fixing member.

Additional objects, features, and strengths of the present invention will be made clear by the description below. Further, the advantages of the present invention will be evident from the following explanation in reference to the drawings.

BRIEF DESCRIPTION OF THE DRAWINGS

FIG. 9 is an explanatory diagram representing a common non-offset range in fixing monochromatic and color images using a fixing apparatus provided in a four-cycle image forming apparatus.

FIG. 10 is an explanatory diagram representing a common non-offset range in fixing monochromatic and color images using a fixing apparatus provided in a four-drum tandem engine image forming apparatus.

DESCRIPTION OF THE EMBODIMENTS

First Embodiment

The following will describe one embodiment of the present invention with reference to FIG. 1 through FIG. 8.

(Apparatus Structure)

Figure 2:
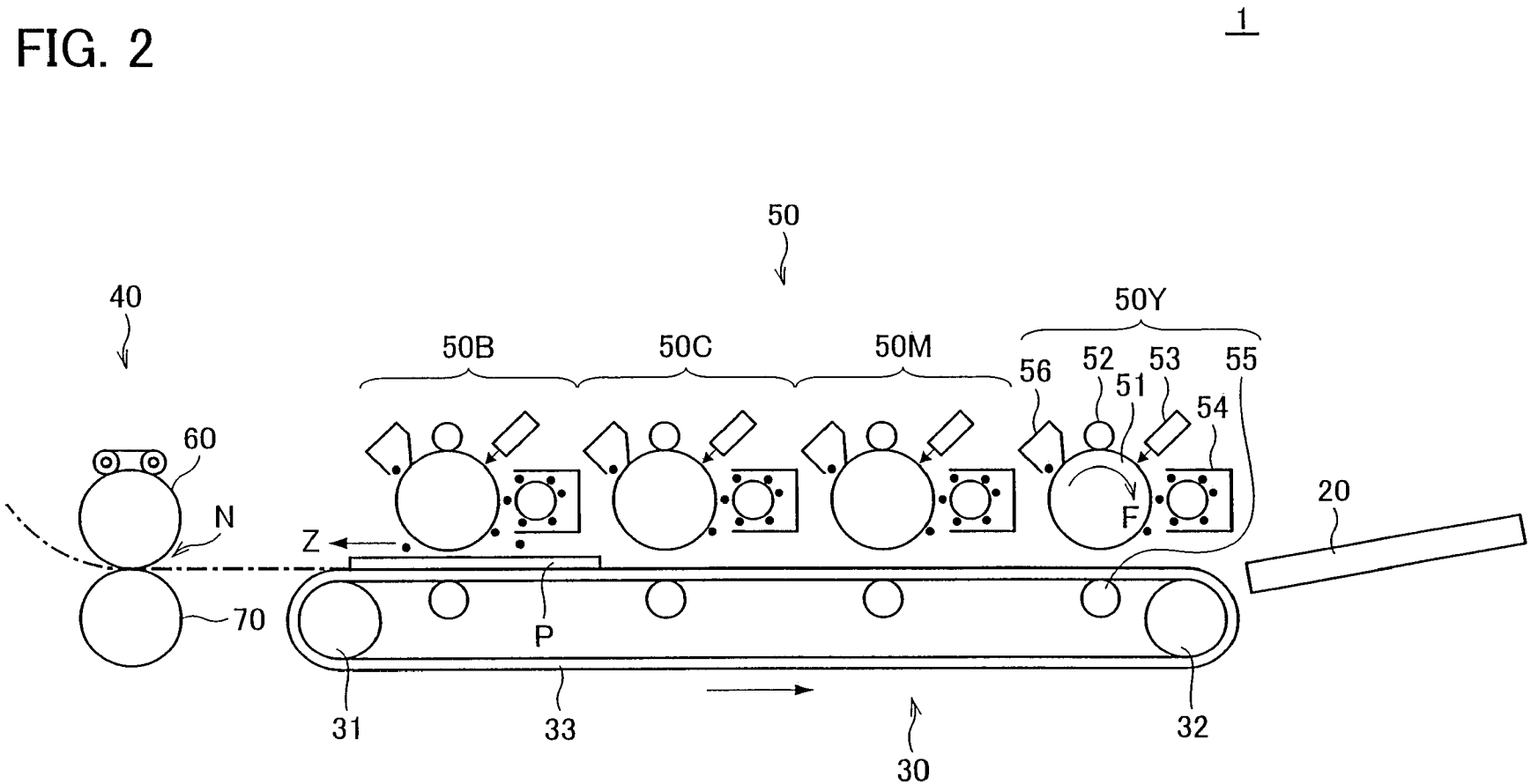
FIG. 2 is a cross sectional view showing a structure of an image forming apparatus according to one embodiment of the present invention.

FIG. 2 schematizes a structure inside a color image forming apparatus of a dry electrophotographic type. An image forming apparatus 1 forms color and monochromatic images on predetermined printing paper based on image data or the like, which is transmitted from terminals on a network, for example.

The image forming apparatus 1 includes visualized image forming units 50 (50Y, 50M, 50C, 50B), a printing paper transporting section 30, a fixing apparatus (heating apparatus) 40, and a paper feed tray 20.

In the image forming apparatus 1, there are provided four visualized image forming units 50Y, 50M, 50C, and 50B, which are disposed side by side and respectively corresponding to colors of yellow (Y), magenta (M), cyan (C), and black (B). The visualized image forming units 50Y, 50M, 50C, and 50B respectively form images using toners of the corresponding colors, yellow (Y), magenta (M), cyan (C), and black (B). The four sets of visualized image forming units 50 (50Y, 50M, 50C, and 50B) are disposed along a transport path that carries a printing paper P from a paper feed tray 20 to the fixing apparatus 40—an arrangement known as the tandem style.

The visualized image forming units 50Y, 50M, 50C, and 50B have essentially the same structure, each including a photoreceptor drum 51, a charger 52, a laser beam scanning means 53, a developing unit 54, a transfer roller 55, and a cleaner unit 56, so that the toners of the respective colors are transferred one over another on the printing paper P as it is transported.

The photoreceptor drum 51 holds images to be formed. The charger 52 uniformly charges a surface of the photoreceptor drum 51 to a predetermined potential. The laser beam scanning means 53 exposes the surface of the photoreceptor drum 51 according to inputted image data to the image forming apparatus 1, after the surface of the photoreceptor drum 51 has been charged by the charger 52. This forms an electrostatic latent image on the surface of the photoreceptor drum 51. The developing unit 54 forms a toner image with color toner, by developing the electrostatic latent image formed on the surface of the photoreceptor drum 51. The transfer roller 55 has a bias voltage of the polarity opposite to that of the toner, so that the toner image formed on the photoreceptor drum 51 is transferred onto the printing paper P as it is transported by a printing paper transporting section 30 (described later). The cleaner unit 56 removes and collects toner remaining on the surface of the photoreceptor drum 51, after the developing process by the developing unit 54 has been completed and the image on the photoreceptor drum 51 has been transferred.

The printing paper transporting means 30 includes a driving roller 31, an idling roller 32, and a transport belt 33. The printing paper transporting means 30 transports the printing paper P so that a toner image is formed thereon by the visualized image forming units 50. The driving roller 31 and the idling roller 32 suspend the transport belt 33 (an endless belt). The transport belt 33 rotates by the rotation of the driving roller 31, which is controlled at a predetermined peripheral velocity. The transport belt 33 has static electricity on an outer surface, so that the printing paper P is transported by being electrostatically attracted thereto.

The printing paper P that has been transported by the transport belt 33 and passed through the visualized image forming units 50Y, 50M, 50C, and 50B with a transferred toner image thereon is stripped from the transport belt 33 at the driving roller 31 and transported to the fixing apparatus 40. By the fixing apparatus 40, the toner image transferred onto the printing paper P is fused onto the printing paper P with suitable heat and pressure, so as to fix the toner and form a stable image. The fixing apparatus 40 includes a fixing roller 60 and a pressing roller 70. The printing paper P that has been transported by the printing paper transporting means 30 is sent to a fixing nip area formed between the fixing roller 60 and the pressing roller 70. The fixing roller 60 and the pressing roller 70 transports the printing paper P held in between. The heat on the periphery of the fixing roller 60 melts and fixes the toner image (unfixed image) formed on the printing paper P. As a result, a glossy toner image is formed on the printing paper P.

Figure 1:
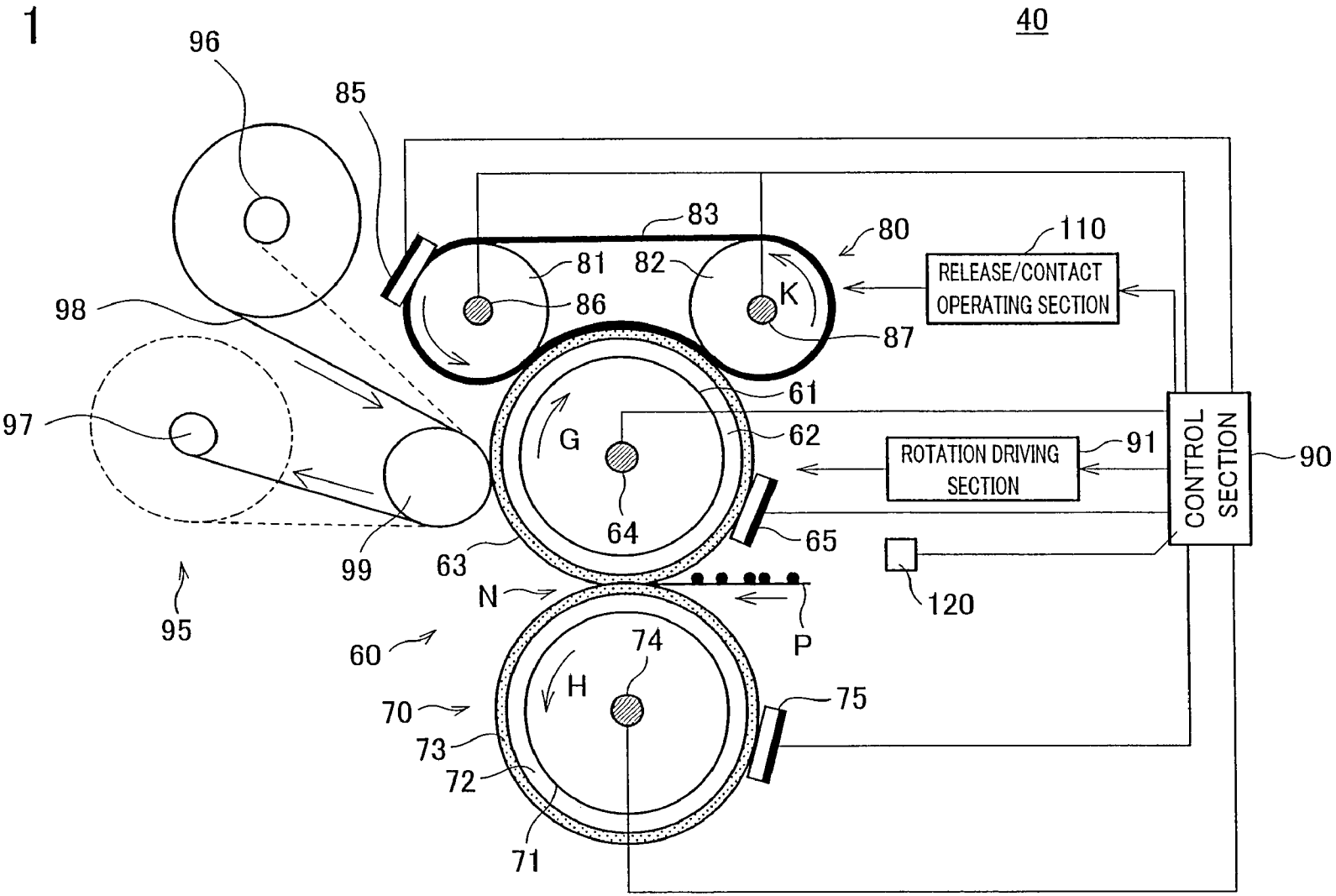
FIG. 1 is a cross sectional view showing a structure of a fixing apparatus according to one embodiment of the present invention.

With reference to FIG. 1, the following describes the fixing apparatus 40 in more detail. FIG. 1 is a diagram schematizing a structure of the fixing apparatus 40. As shown in FIG. 1, the fixing apparatus 40 includes: an external heating section 80, a cleaning section 95, thermistors (temperature detecting elements) 65, 75, and 85, a rotation driving section 91, a release/contact operating section 110, a printing paper sensor 120, and a control section 90, in addition to the fixing roller 60 and the pressing roller 70. The thermistors 65, 75, and 85 detect surface temperatures of the fixing roller 60, the pressure roller 70, and the external heating section 80, respectively.

The fixing roller 60 rotates in a direction of G shown in FIG. 1 by the driving force of the rotation driving section 91. The fixing roller 60 includes: a metal core 61, which is a hollow metal cylinder; an elastic layer 62 covering the periphery of the metal core 61; and a releasing layer 63 covering the elastic layer 62. Inside the metal core 61, there is provided a halogen lamp 64 as a heat source.

For example, the metal core 61 is a hollow aluminum cylinder with an outer diameter of 46 mm. The material of the metal core 61 is not just limited to aluminum, and iron may be used, for example.

The elastic layer 62 is a heat-resistant silicone rubber with a thickness of, for example, 2 mm. The material of the releasing layer 63 is not particularly limited as long as it is heat resistant, durable, and provides good release from toner. Specifically, fluorocarbon materials such as PFA (co-polymer of tetrafluoroethylene and perfluoroalkylvinylether) and PTFE (polytetrafluoroethylene) may be used, for example. In the present embodiment, the releasing layer 63 is a PFA tube with a thickness of about 30 μm. The fixing roller 60 having such a construction has an outer diameter of 50 mm and a surface hardness of 68 (Asker C).

In the present embodiment, only one halogen lamp 64 is installed. However, the present invention is not just limited to such an example. For example, two halogen lamps 64, one for small-size printing paper and one for large-size printing paper, may be provided that are independently turned on for each paper size, so that an optimum temperature distribution can be formed for each size of printing paper P.

In the present embodiment, the thermistor 65 is disposed in contact with the surface of the releasing layer 63. Further, in the present embodiment, the thermistor 65 is disposed at a middle portion in a longitudinal direction of the fixing roller 60. However, the present invention is not just limited to such an example, and the thermistor 65 may be disposed at end portions (non paper feed regions) in the longitudinal direction of the fixing roller 60. When two halogen lamps 64 are provided in the metal core 61 and the amount of heat is different at the middle portion and an end portion in the longitudinal direction of the fixing roller 60, the thermistor 65 may be provided at each of these portions.

The pressing roller 70 rotates in a direction of H (opposite to direction G) shown in FIG. 1, and includes: a metal core 71, which is a hollow metal cylinder; an elastic layer 72 covering the periphery of the metal core 71, and a releasing layer 73 covering the elastic layer 72. Inside the metal core 71, there is provided a halogen lamp 74 as a heat source. The pressing roller 70 is pressed against the fixing roller 60, for example, by an elastic member such as a spring (not shown). As a result, a nip area (fixing nip area N) is formed between the fixing roller 60 and the pressing roller 70.

The metal core 71 is, for example, a hollow aluminum cylinder with an outer diameter of 46 mm. The material of the metal core 71 is not just limited to aluminum, and iron may be used, for example.

The elastic layer 72 is a heat-resistant silicone rubber with a thickness of 2 mm. The material of the releasing layer 73 is not particularly limited as long as it is heat resistant, durable, and provides good release from toner. Specifically, fluorecarbon materials such as PFA (co-polymer of tetrafluoroethylene and perfluoroalkylvinylether) and PTFE (polytetrafluoroethylene) may be used, for example. In the present embodiment, the releasing layer 73 is a PFA tube with a thickness of about 30 μm. The fixing roller 70 having such a construction has an outer diameter of 50 mm and a surface hardness 75 (Asker C).

The thermistor 75 is provided in contact with the surface of the releasing layer 73 as with the thermistor 65.

The pressing roller 70 has a greater rubber hardness than the fixing roller 60. This is to create a "reversed" fixing nip area N between the pressing roller 70 and the fixing roller 60. As used herein, the "reversed fixing nip area N" refers to a profile of fixing nip area N protruding upward due to the pressing roller 70 depressing the fixing roller 60 inward at the fixing nip area N.

By the "reversed" fixing nip area N, the printing paper P passing the fixing nip area N is bent downward along the pressure roller 70. This allows the printing paper P to readily self-strip from the fixing roller 60 by virtue of its stiffness, when fixing the toner image onto the printing paper P. In this way, the printing paper P can be striped without much help from forced stripping assisting means such as a stripping claw. Thus, by the self-stripping capability combined with the stripping claw, the fixing apparatus 40 with the "reversed" fixing nip area N can desirably strip the printing paper P from the fixing roller 60. In the present embodiment, the fixing nip area N has a nip width of 8.5 mm.

When the pressing roller 70 has a smaller surface hardness than that of the elastic layer 62 of the fixing roller 60, a "forward" fixing nip area N is formed that protrudes downward. In this case, the printing paper P passing the fixing nip area N is bent upward along the fixing roller 60, with the result that the printing paper P cannot self-strip sufficiently in the fixing apparatus 40.

The following describes the cleaning section 95. The cleaning section 95 is provided to clean contamination such as offset toner that has adhered to the surface of the fixing roller 60 when fixing the toner image formed on the printing paper P. To this end, the cleaning section 95 includes a sending roller 96, a winding roller 97, a cleaning web 98, and a web-contacting roller 99.

The cleaning web 98 is a strip of fabric. When unused, most of the cleaning web 98 is wound around the sending roller 96. When in use, the cleaning web 98 is continuously wound around the winding roller 97 as it is used. The cleaning web 98 is pressed against the fixing roller by the web-contacting roller 99 in a portion between the sending roller 96 and the winding roller 97. That is, the cleaning web 98 is set between the fixing roller 60 and the web-contacting roller 99, and, when the fixing roller 60 rotates, the cleaning web 98 wipes out contamination such as offset toner adhering on the surface of the fixing roller 60.

As the cleaning web 98, heat-resistant nonwoven fabric such as Nomex® or Himelon® may be used, which is prepared by mixing soft polyester fibers into aromatic polyamide fibers at high temperature to provide suitable softness and strength. The cleaning web 98 preferably has a thickness in a range of 30 μm to 100 μm. In the present embodiment, the cleaning web 98 has a thickness of 40 μm.

Further, the cleaning web 98 has been impregnated at high temperature with silicone oil that has a viscosity of about 0.01 $m^2/s$ (10000 centistokes). Any silicone oil commonly used in the art can be used. For example, a dimethyl silicone oil can be used. Other examples include denatured silicone oils such as an amino denatured oil, a mercapto denatured oil, and a fluoro denatured oil.

The web-contacting roller 99 has an elastic layer sheathed around a metal core. As the elastic layer, a heat-resistant rubber such as silicone rubber can be used. Preferably, a foaming agent is included in the rubber to provide sufficient softness and a spongy form. Preferably, the web-contacting roller 99 has a rubber hardness of 20 to 30 (Asker C).

The web-contacting roller 99 is rotably supported by bearings (not shown) at the both ends in the longitudinal direction (axial direction). The bearings are pressed against the fixing roller 60 with a spring (not shown). The pressure against the fixing roller 60 is preferably no less than 3793.6 Pa (0.039 $kgf/cm^2$) from the standpoint of preventing leaking of offset toner, and no more than 18967.9 Pa (0.19 $kgf/cm^2$) from the standpoint of preventing damage to the surface of the releasing layer 63 of the fixing roller 60, for which a PFA tube is used.

The width in the longitudinal direction of the web-contacting roller 99 preferably covers the image forming region. In the present embodiment, the web-contacting roller 99 has a width of 310 mm. The web-contacting roller 99 has a roller diameter of 20 mm.

When predetermined numbers of printing paper P have passed through the fixing nip area N, the cleaning web 98 is taken up by a certain amount in the direction of arrow shown in FIG. 1 (for example, the cleaning web 98 is taken up by 0.5 mm after a fixing process has been completed for six sheets of printing paper P). This is performed as a motor (not shown) rotates the winding roller 97 in response to an operating signal from a control section (not shown). In the present embodiment, the winding roller 97 is rotated intermittently. However, the winding roller 97 may be rotated continuously according to the timing at which the printing paper P passes through the fixing nip area N.

Upon reaching an area of contact (cleaning nip area) between the fixing roller 60 and the web contacting roller 99, the cleaning web 98 supplies the impregnated silicone oil to the fixing roller 60 and cleans the offset toner adhering to the fixing roller 60.

In the following, description is made as the external heating section 80. The external heating section 80 includes two heat rollers 81 and 82, and an endless belt 83 suspended by the heat rollers 81 and 82. The heat rollers 81 and 82 are pressed against the fixing roller 60 via the endless belt 83, using an elastic member (spring 106) to be described later. As a result, a heating nip area is formed between the external heating section 80 and the fixing roller 60.

In addition to the heat rollers 81 and 82 supporting the endless belt 83, the external heating section 80 may optionally include a tension roller (not shown) that applies a suitable tension to the endless belt 83. By the arrangement including a tension roller, the endless belt 83 can be supported with an appropriate tension even when the endless belt 83 extends over a long distance (long contact distance) over the fixing roller 60 in order to provide a wide nip area between the fixing roller 60 and the endless belt 83.

In the present embodiment, the heat rollers 81 and 82 of the external heating section 80 are each provided as an aluminum metal core with an outer diameter of 15 mm and a thickness of 1 mm. As required, a releasing layer may optionally be provided on the metal core when, for example, the frictional force between the inner surface of the endless belt 83 and the heat rollers 81 and 82 needs to be decreased in order to reduce the skew force caused by wobbling. The material of the releasing layer is not particularly limited as long as it is heat resistant, durable, and provides good release from toner. For example, PFA (copolymer of tetrafluoroethylene and perfluoroalkylvinylether), PTFE (polytetrafluoroethylene), or other types of fluorocarbon materials may be used.

Inside the heat rollers 81 and 82, there are provided halogen lamps 86 and 87, respectively, as heat sources. To be more specific, the halogen lamp 86 is provided inside the metal core of the heat roller 81, and the halogen lamp 87 is provided inside the metal core of the heat roller 82.

In the present embodiment, the endless belt 83 has a bilayer structure, in which a releasing layer (PTFE), 10 μm thick, is formed around a polyimide belt-base having an outer diameter of 30 mm and a thickness of 90 μm. The thickness and material of the belt-base is not limited to these examples. For example, the belt-base may be made of metal such as nickel, stainless steel, or iron. The material of the releasing layer is not particularly limited as long as it is heat resistant, durable, and provides good release from toner. For example, PFA (copolymer of tetrafluoroethylene and perfluoroalkylvinylether), PTFE (polytetrafluoroethylene), or other types of fluorocarbon materials may be used.

Because the two heat rollers 81 and 82 are thin and small and the endless belt 83 is thin, the temperature of the fixing roller 60 can be quickly raised.

The thermistor 85 is provided in contact with a surface of the endless belt 83. More specifically, the thermistor 85 is in contact with the endless belt 85 on the heat roller 81.

In the external heating section 80 of the present embodiment, the heat rollers 81 and 82 have the same shape and use the same heat source (halogen lamps 86 and 87 have the same specifications), and as such the thermistor 85 for detecting a surface temperature of the endless belt 83 is provided only for the heat roller 81. That is, only one thermistor is provided.

The heat rollers 81 and 82 are not necessarily required to have the same shape. When the heat rollers 81 and 82 have different shapes, it is preferable to provide two thermistors on the endless belt 83, so that temperatures of the heat rollers 81 and 82 can be respectively detected by the two thermistors.

On the both ends in the axial direction of the heat rollers 81 and 82, there are provided slipper bearings. The material of the slipper bearings are not particularly limited as long as it is heat resistant, wear resistant, and low frictional. In the present embodiment, the slipper bearings are used because the heat rollers 81 and 82 have a small diameter and a sufficient center distance cannot be provided. However, when there is no space restriction, ball bearings may be used.

The heat rollers 81 and 82 rotate by the rotation of the fixing roller 60. Specifically, the fixing roller 60 is attached to the rotation driving section 91 via driving gears, and the rotation driving section 91 rotates the fixing roller 60. The rotation of the fixing roller 60 causes the endless belt 83 and the heat rollers 81 and 82 to rotate by the frictional force generated at the area of contact (heating nip area) between the endless belt 83 and the fixing roller 60.

In the present embodiment, the heating nip area has a width of 20 mm.

Figure 3:
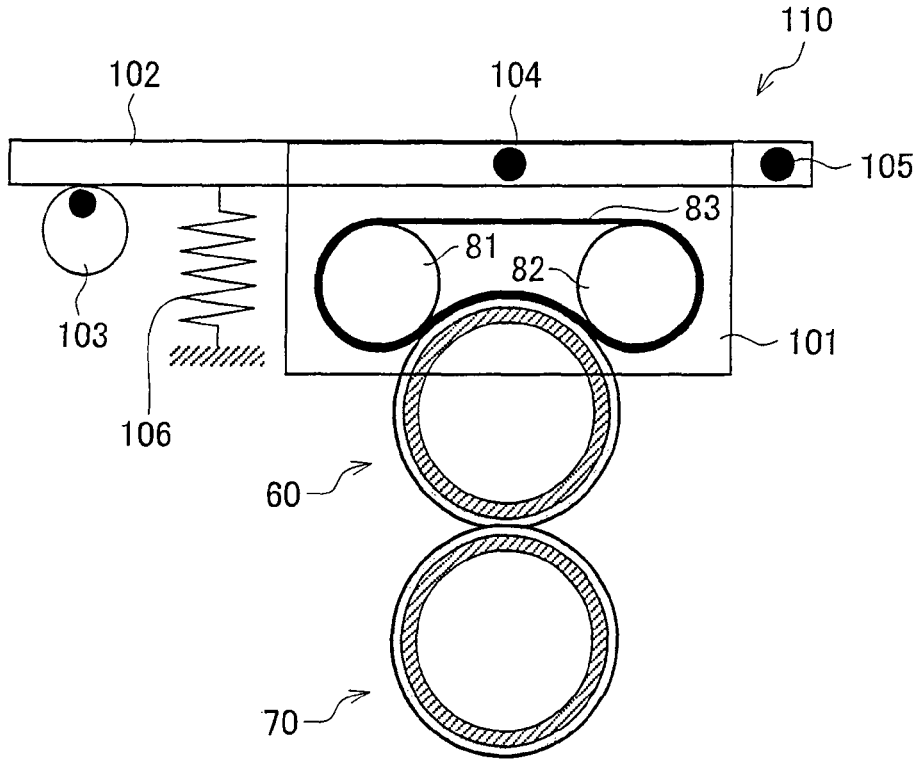
FIG. 3 is a cross sectional view showing a structure of a release/contact operating section for performing release/contact of an external heating section provided in the fixing apparatus according to one embodiment of the present invention, in which the external heating section is in contact with the fixing roller.
Figure 4:
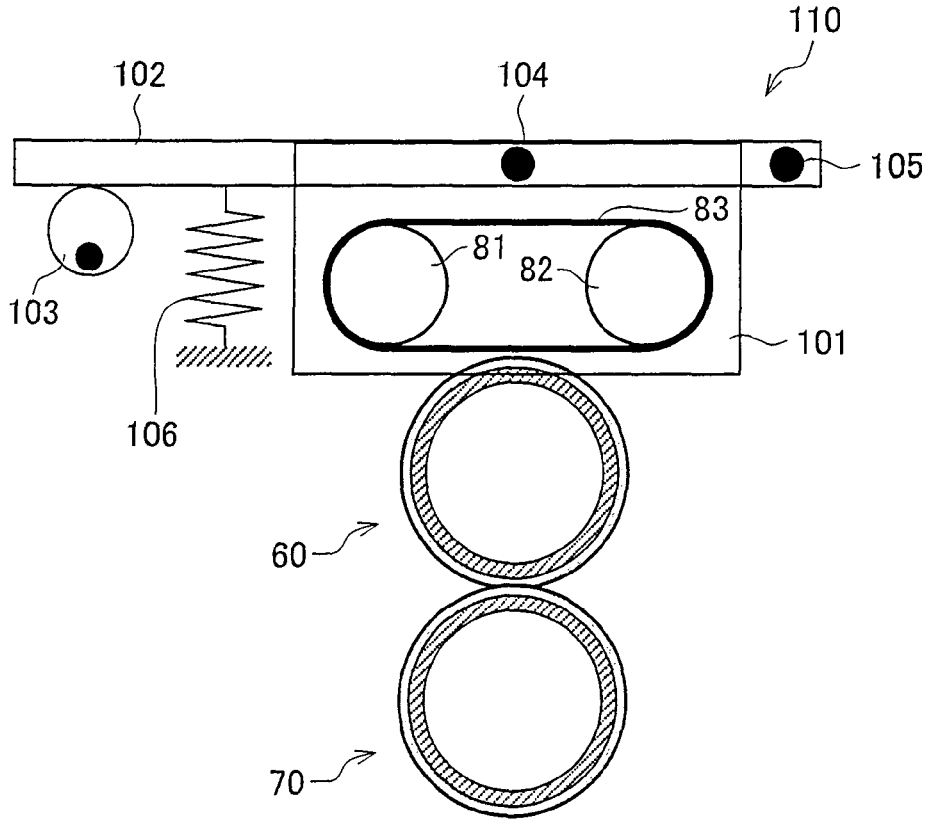
FIG. 4 is a cross sectional view showing a structure of a release/contact operating section for performing release/contact of an external heating section provided in the fixing apparatus according to one embodiment of the present invention, in which the external heating section is separated from the fixing roller.

By the provision of the contact/contact section 110, the external heating section 80 can be brought into contact with or separated from the fixing roller 60. FIG. 3 and FIG. 4 are explanatory views showing an exemplary structure of the release/contact operating section 110. FIG. 3 shows the external heating section 80 in contact with the fixing roller 60. FIG. 4 shows the external heating section 80 separated from the fixing roller 60.

As shown in FIGS. 3 and 4, the release/contact section 110 includes sideboards 101, an arm 102, an eccentric cam 103, a fulcrum 104, a fulcrum 105, and a spring 106. The sideboards 101 are provided on the both sides of the heat rollers 81 and 82 to rotably support the heat rollers 81 and 82 via bearings (not shown) or the like. Further, the sideboards 101 are rotably supported on the arm 102 at the fulcrum 104, so that the sideboards 101 can rotate in directions perpendicular to the axial direction of the heat rollers 81 and 82.

One end of the arm 102 is rotably supported on a frame (not shown) of the fixing apparatus 40 and at the fulcrum 105, so that the arm 102 is pushed against the spring 106 about the fulcrum 105, in a direction toward the fixing roller 60.

The eccentric cam 103 is provided in contact with the other end of the arm 102. The eccentric cam 103 is driven to rotate by driving means (not shown) such as a motor. Operations of the driving means are controlled by the control section 90. By controlling the driving means, the control section 90 rotates the eccentric cam 103 to move the arm 102 away from the fixing roller 60 (FIG. 4) or toward the fixing roller 60 (FIG. 3). By the movement of the arm 102, the endless belt 83 is pressed against the fixing roller 60 or separated from the fixing roller 60.

In the present embodiment, the external heating section 80 is adapted so that, when it is separated, the endless belt 83 is completely separated from the fixing roller 60, as shown in FIG. 4. However, the present invention is not just limited to such an arrangement. When the external heating section 80 is separated, the endless belt 83 may partially remain in contact with the fixing roller 60.

The printing paper sensor 120 is provided upstream of the fixing nip area N to detect that the leading edge and/or end portion of the printing paper P has passed through the fixing nip area N. The printing paper sensor 120 for detecting passage of the printing paper P may be a contact sensor or an optical sensor.

The control section 90 controls the respective components of the fixing apparatus 40. Specifically, the control section 90 (1) individually obtains detected temperatures from the thermistors 65, 75, and 85, (2) individually controls supplied power to the halogen lamps 64, 74, 86, and 87, (3) controls ON/OFF and rotation speed of the rotation driving section 91 for rotating the fixing roller 60, (4) controls operations of the release/contact operating section 110 for bringing the external heating section 80 into contact with the fixing roller 60 or separating the external heating section 80 therefrom, and (5) obtains a detection signal, indicative of passage of the printing paper P, from the printing paper sensor 120.

The control section 90 may be realized by hardware logic, or by software using a CPU, as described below.

Specifically, the fixing apparatus 40 (or image forming apparatus 1) includes: a CPU (central processing unit) for executing commands for the control programs that realize respective functions of the control section 90; a ROM (read only memory) in which the programs are stored; a RAM (random access memory) that develop the programs; and a storage device (storage medium), such as memory, in which the programs and various data are stored. The objects of the present invention can be achieved with a computer-readable storage medium in which program code (executable program, intermediate code program, source program) for the control programs, i.e., software for realizing the functions of the control section 90, is stored, and by supplying the storage medium to the fixing apparatus 40 (or image forming apparatus 1) and reading and executing the program code by a computer (or CPU, MPU).

For example, such storage media may be tapes such as magnetic tapes and cassette tapes; disks such as magnetic disks like floppy disk® and hard disk, and optical disks such as CD-ROM, MO, MD, DVD, and CD-R; cards such as IC cards (including memory cards) and optical cards; or semiconductor memories such as mask ROM, EPROM, EEROM, and flash ROM.

Further, the fixing apparatus 40 (or image forming apparatus 1) may be arranged so as to be connectable to a communications network, and the program code may be supplied through the communications network. Examples of the communication network include, but are not particularly limited to, the Internet, intranet, extranet, LAN, ISDN, VAN, CATV communications network, virtual private network, telephone network, mobile communications network, and satellite communications network. Further, a transmission medium that constitutes the communications network is not particularly limited. The transmission medium may be, for example, wired lines such as IEEE 1394, USB, power-line carrier, cable TV lines, telephone lines, or ADSL lines; or wireless connections such as IrDA and a remote control using infrared light, Bluetooth®, 802.11, HDR, mobile phone network, satellite connections, and terrestrial digital network. Note that the present invention can also be realized in the form of a computer data signal embedded in a carrier wave, as embodied by electronic transmission of the program code.

(Apparatus Operations)

Figure 5:
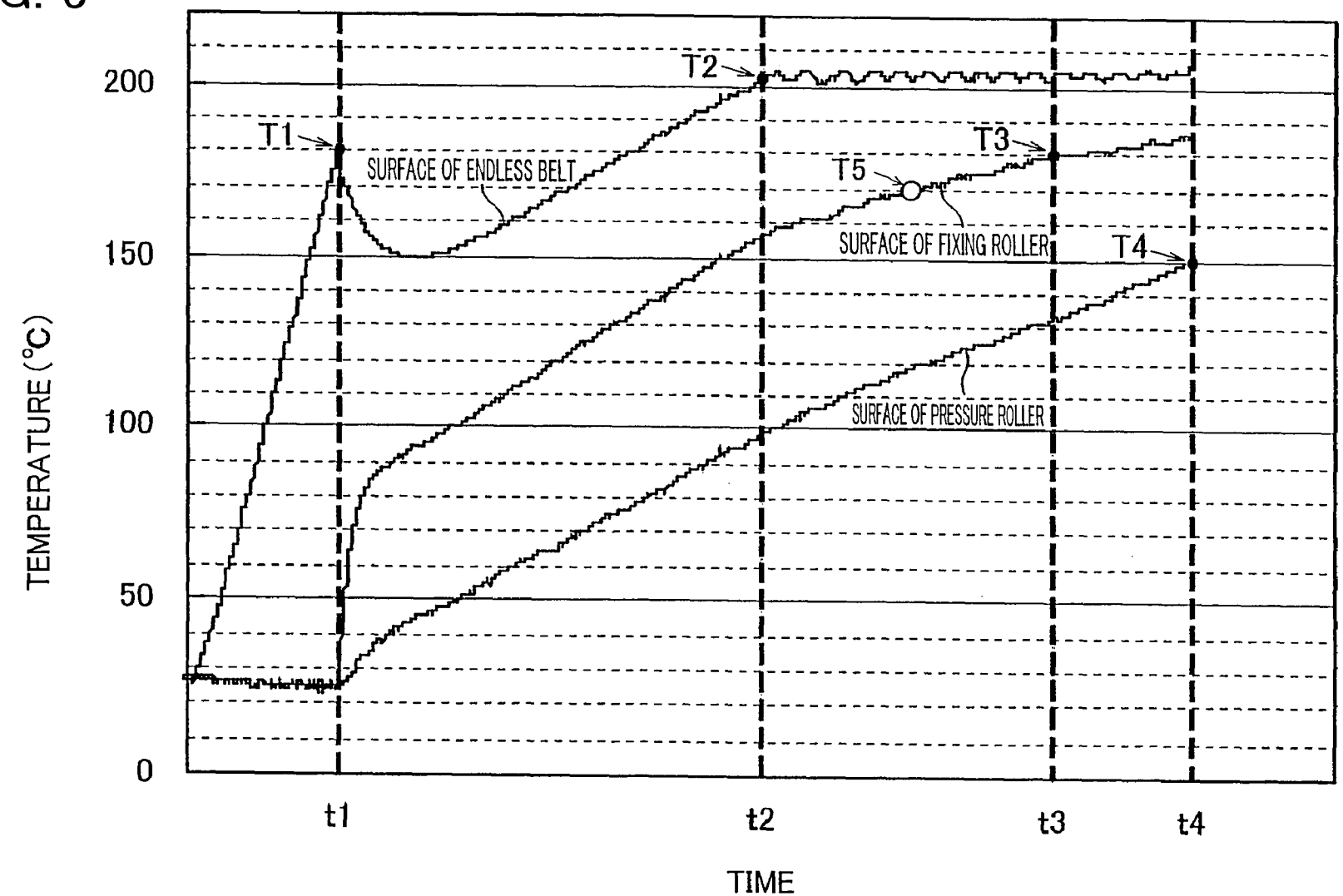
FIG. 5 is a diagram representing changes in surface temperature of an endless belt of the external heating section, a fixing roller, and a pressure roller during warm-up of the fixing apparatus from room temperature, according to one embodiment of the present invention.
Figure 6:
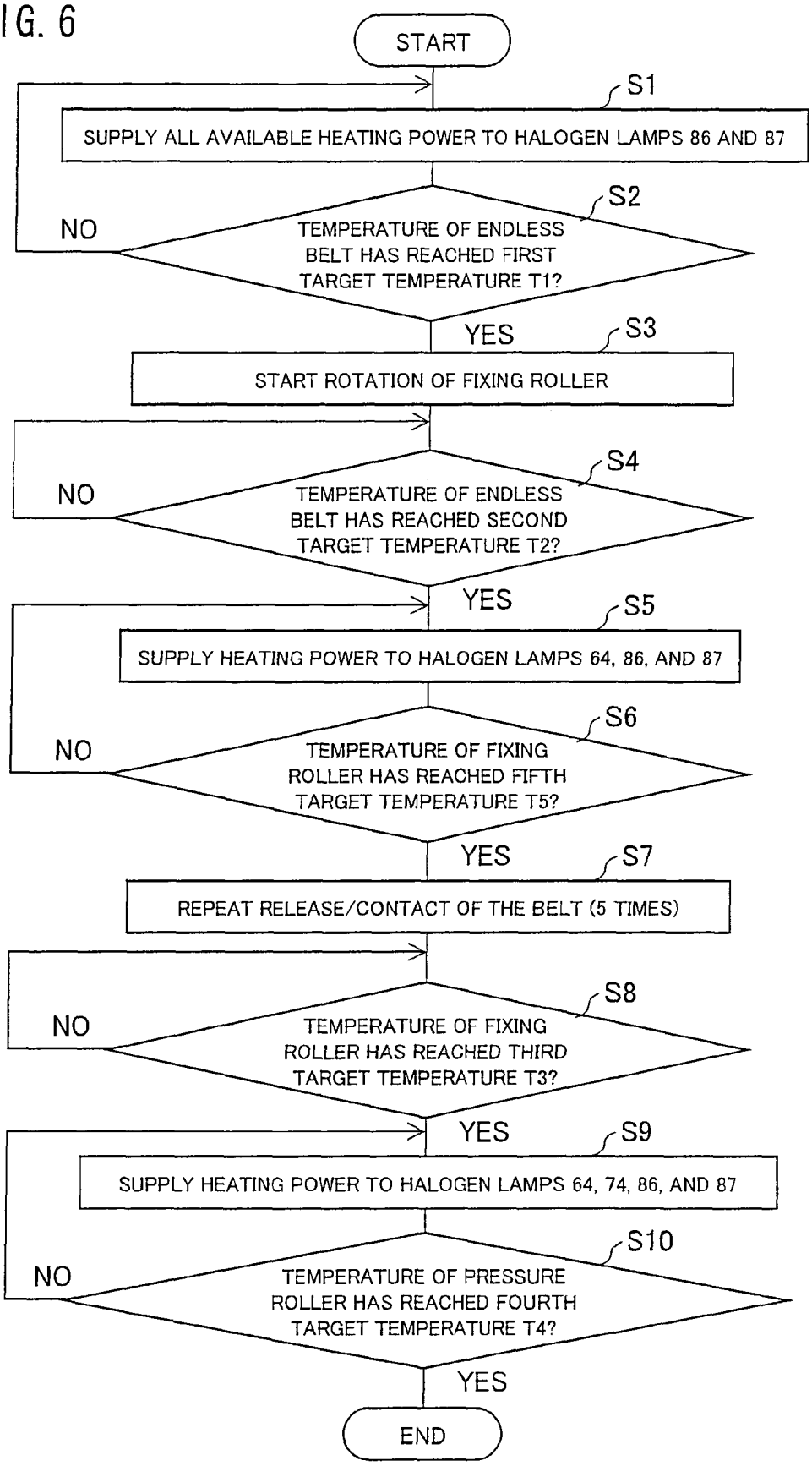
FIG. 6 is a flow chart explaining how respective components of the fixing apparatus are controlled during warm-up of the fixing apparatus from room temperature, according to one embodiment of the present invention.

With reference to FIG. 5 and FIG. 6, the following specifically describes how the components of the fixing apparatus 40 having the foregoing structure are controlled during warm-up from room temperature. Generally, a warm-up is performed when the image forming apparatus 1 is turned on.

FIG. 5 is a graph representing changes in surface temperature of the external heating section 80 (endless belt 83), the fixing roller 60, and the pressure roller 70 during warm-up of the fixing apparatus 40 starting from room temperature. FIG. 6 is a flow chart representing operations of the control section 90 controlling the external heating section 80, the fixing roller 60, and the pressure roller 70 during warm-up. Here, room temperature is 25° C., and the final warm-up temperatures (target temperatures) are 205° C. (T2), 185° C. (T3), and 150° C. (T4) for the external heating section 80 (endless belt 83), the fixing roller 60, and the pressure roller 70, respectively.

In controlling a rate of temperature increase during warm-up of the fixing apparatus 40, the control section 90 distributes all available power for the halogen lamps by giving priority to the external heating section 80, the fixing roller 60, and the pressure roller 70 in this order. Specifically, all available power (hereinafter, "heat source power") for the heat sources of the fixing apparatus 40 is supplied to the heat sources (halogen lamps 86 and 87) of the heat rollers 81 and 82 until the surface temperature (as detected by the thermistor 85) of the endless belt 83 of the external heating section 80 reaches the second target temperature T2. When the surface temperature of the endless belt 83 has reached the second target temperature T2 and the warm-up of the external heating section 80 is completed, the heat source power that has been supplied to the halogen lamps 86 and 87 of the heat rollers 81 and 82 is distributed to the heat source (halogen lamp 64) of the fixing roller 60 to heat the fixing roller 60. When the surface temperature of the fixing roller (as detected by the thermistor 65) has subsequently reached the third target temperature T3 and the warm-up of the fixing roller 60 is completed, the heat source power that has been supplied to the halogen lamps 86 and 87 of the external heating section 80, and the halogen lamp 64 of the fixing roller 60 is further distributed to the halogen lamp 74 of the pressure roller 70. A warm-up of the fixing apparatus 40 completes when the surface temperature of the pressure roller 70 has reached the fourth target temperature T4 and the warm-up of the pressure roller 70 is completed.

By first heating the heat rollers 81 and 82 of the external heating section 80, the heat applied to the heat rollers 81 and 82 is transferred to the fixing roller 60 via the endless belt 83. This makes it possible to efficiently raise only the surface temperature of the fixing roller 60, and always maintain a greater temperature for the heat rollers 81 and 82 than for the fixing roller 60.

In warming up the fixing apparatus 40, the control section 90 first controls a power supply section (not shown) for the halogen lamps 86 and 87 of the heat rollers 81 and 82 of the external heating section 80 so that all power is supplied to the halogen lamps 86 and 87, thereby starting a heating operation in the external heating section 80 (S1) (FIG. 6). Here, under the control of the control section 90, all available power (hereinafter, "heat source power") for heating the fixing roller 60, the pressure roller 70, and the external heating section 80 (halogen lamps 64, 74, 86, and 87) in the fixing apparatus 40 is supplied to the halogen lamps 86 and 87. The control section 90 also controls the release/contact operating section 110 to bring the external heating section 80 into contact with the fixing roller 60.

In S2, the control section 90 obtains a detected temperature from the thermistor 85, and determines whether the surface temperature of the endless belt 83, i.e., the temperature as detected by the thermistor 85 has reached the first target temperature T1. In the present embodiment, the first target temperature T1 is set at 180° C. Note that, due to a small heat capacity of the external heating section 80, the time t1 required to reach the first target temperature T1 from the start of warm-up operation is very short.

If it is determined in S2 that the temperature detected by the thermistor 85 has not reached the first target temperature T1, the control section 90 continues supplying power to the halogen lamps 86 and 87, and keeps monitoring the temperature until the first target temperature T1 is reached.

If it is determined in S2 that the temperature detected by the thermistor 85 has reached the first target temperature T1, the control section 90 controls the rotation driving section 91 to rotate the fixing roller 60 (S3). As a result, the fixing roller 60, the pressure roller 70, and the external heating section 80 rotate. At the start of rotation of the fixing roller 60, the surface temperature of the endless belt 83 drops momentarily before it starts to rise again, as shown in FIG. 5.

In S4, the control section 90 obtains a detected temperature from the thermistor 85, and determines whether the surface temperature of the endless belt 83 has reached the second target temperature T2. If it is determined that the temperature detected by the thermistor 85 has not reached the second target temperature T2, the control section 90 continues supplying power to the halogen lamps 86 and 87, and keeps monitoring the temperature until the second target temperature T2 is reached.

When the temperature detected by the thermistor 85 has reached the second target temperature T2, the heat source power that has been supplied to the halogen lamps 86 and 87 of the external heating section 80 is distributed to the halogen lamp 64 of the fixing roller 60 (S5). Specifically, when the temperature detected by the thermistor 85 has reached the second target temperature T2, the control section 90, for example, reduces the supplied power to the halogen lamps 86 and 87 to leave only the amount of power necessary to maintain the surface temperature of the endless belt 83 at the second target temperature T2. The remaining heat source power is distributed to the halogen lamp 64. When the temperature detected by the thermistor 85 is at or above the second target temperature T2, the heat source power is supplied only to the halogen lamp 64. At this point, as shown in FIG. 5, the surface temperature of the fixing roller 60 has been increased to a certain temperature (about 160° C. in FIG. 5) by the transferred heat from the endless belt 83.

In S6, the control section 90 determines whether the surface temperature of the fixing roller 60, i.e., the temperature detected by the thermistor 65 has reached a fifth target temperature T5. In the present embodiment, the fifth target temperature T5 is set at 170° C. If it is determined that the temperature detected by the thermistor 65 has not reached the fifth target temperature T5, the control section 90 continues supplying power to the halogen lamp 64 and the halogen lamps 86 and 87, and keeps monitoring the temperature until the fifth target temperature T5 is reached.

If it is determined in S6 that the temperature detected by the thermistor 65 has reached the fifth target temperature T5, the control section 90 controls the release/contact operating section 110 so as to enable a release/contact operation for the external heating section 80 in contact with the fixing roller 60 (S7), as described below.

On the endless belt 83 of the external heating section 80, there is an accumulation of offset toner that has been transferred from the fixing roller 60 in the previous image forming operations. In S7, the release/contact operation for the external heating section 80 is repeated to transfer the accumulated offset toner on the endless belt 83 back to the fixing roller 60, by utilizing the force of impact. The offset toner transferred to the fixing roller 60 is transported to the cleaning nip area, and collected by the cleaning section 95.

In the warm-up process, there is no paper feed for extended time periods. As such, the offset toner transferred to the fixing roller 60 passes through the fixing nip area N and is collected by the cleaning section 95 without contaminating the printing paper P. By actively performing the release/contact operation for the external heating section 80 during warm-up, the offset toner accumulated on the endless belt 83 of the external heating section 80 can be removed in advance of image formation on the printing paper P.

It is preferable that the release/contact operation for the external heating section 80 be repeated. More specifically, the release/contact operation for the external heating section 80 is preferably repeated N times, which satisfy the following Formula (1):

$$N \geqq \mathrm{Lex}/Ln \tag{1}$$

where Ln is the periphery length of the heating nip area, which is an area of contact between the endless belt 83 of the external heating section 80 and the fixing roller 60, Lex is the periphery length of the endless belt 83, and N is the number of times the release/contact operation for the external heating section 80 is repeated (a set of release and contact being one round of release/contact operation). Referring to Formula (1), a single round of contact removes toner from the endless belt 83 over length Ln. It follows from this that, when the combined length of contact portion for N contact operations (N×Ln) is equal to or greater than the total periphery length Lex, all toner on the endless belt 83 can be removed.

Further, when the rotation speed on the periphery of the fixing roller 60 (rotation speed of the endless belt 83) during warm-up (release/contact operation) of the external heating section 80 is V, the contact time t for each release/contact operation preferably satisfies the following Formulae (2) and (3):

$$\mathrm{Lex}\times A/V < t \leqq (Ln + \mathrm{Lex}\times A)/V\ tm \tag{2}$$

$$N \geqq \mathrm{Lex}/(V\times t - \mathrm{Lex}\times A) \tag{3}$$

where A is an integer equal to or greater than 0, indicative of the number of rotations of the endless belt 83 for one round of contact.

Formula (2) specifies a condition where, when there are one or more rotations of the endless belt 83 for each contact, a misalignment that occurs on the endless belt 83 for each contact is equal to or shorter than the length Ln of the contact portion. This enables toner on the endless belt 83 to be removed without any gap, from upstream to downstream of the endless belt 83. Formula (3) specifies a condition where, when there are one or more rotations of the endless belt 83 for each contact as in Formula (2), all parts of the endless belt 83 along the periphery are in contact with the fixing roller 60 in N contact operations.

It should be noted that A may be 0 (less than one rotation of the endless belt 83 for one round of contact). In this case the release/contact operation for the external heating section 80 needs to be completed in a considerably short time period. When A is 1 or greater, more time is available for the release/contact operation of the external heating section 80, making it easier to control the release/contact operation. It is therefore preferable that A be a natural number.

By setting the number N of release/contact operations and the contact time t for each release/contact operation to satisfy the foregoing conditions, the endless belt 83 contaminated with toner can be cleaned over the entire periphery. In the present embodiment, the periphery length Ln of the heating nip area is 20 mm, and the total periphery length Lex of the endless belt 83 is 94.2 mm. As such, the number N of release/contact operations is set to 5. Further, since the rotation speed V of the fixing roller 60 during warm-up (release/contact operation) is 170 mm/s, the contact time t for each release/contact operation is set between 1.662 seconds and 1.78 seconds, when the number of rotations of the endless belt 83 for each contact is 3 for example. The number of release/contact operations can be determined from Formula (3). For example, when the number of rotations of the endless belt 83 is 3 and the contact time is 1.78 seconds, the number of release/contact operations is 5.

In S8, the control section 90 determines whether the surface temperature of the fixing roller 60, i.e., the temperature detected by the thermistor 65 has reached the third target temperature T3. If it is determined that the temperature detected by the thermistor 65 has not reached the third target temperature T3, the control section 90 continues supplying power to the halogen lamps 86 and 87, and keeps monitoring the temperature until the third target temperature T3 is reached.

If it is determined in S8 that the temperature detected by the thermistor 65 has reached the third target temperature T3, the heat source power that has been supplied to the halogen lamp 64 and the halogen lamps 86 and 87 is distributed by the control section 90 to the halogen lamp 74 of the pressure roller 70 (S9). Specifically, when the temperature detected by the thermistor 65 has reached the third target temperature T3, the control section 90 controls the supplied power to the halogen lamps 86 and 87 so as to maintain the surface temperature of the endless belt 83 at the second target temperature T2. Here, the control section 90 also controls the supplied power to the halogen lamp 64 so as to maintain the surface temperature of the fixing roller 60 at the third target temperature T3. The remaining heat source power is distributed to the halogen lamp 74. When the temperature detected by the thermistor 65 is equal to or greater than the third target temperature T3 and when the temperature detected by the thermistor 85 is equal to or greater than the second target temperature T2, the power is supplied only to the halogen lamp 74. At this point, as shown in FIG. 5, the surface temperature of the pressure roller 70 has been increased to a certain temperature (about 130° C. in FIG. 5) by the transferred heat from the fixing roller 60.

In S10, the control section 90 determines whether the surface temperature of the pressure roller 70, i.e., the temperature detected by the thermistor 75 has reached the fourth target temperature T4. If it is determined that the temperature detected by the thermistor 75 has not reached the fourth target temperature T4, the control section 90 continues supplying power to the halogen lamps 86 and 87, and keeps monitoring the temperature until the fourth target temperature T4 is reached.

If it is determined in S10 that the temperature detected by the thermistor 75 has reached the fourth target temperature T4, the control section 90 completes the warm-up operation of the fixing apparatus 40. This makes the fixing apparatus 40 ready for the fixing process. Further, at the end of warm-up, the rotation of the fixing roller 60 is stopped, which stops the rotation of the endless belt 83 and the pressure roller 70 of the external heating section 80. This brings the fixing apparatus 40 into a standby mode. In the transition to the standby mode, the control section 90 controls the release/contact operating section 110 to separate the external heating section 80 from the fixing roller 60. Thus, in the standby mode, the external heating section 80 is separated from the fixing roller 60.

In the warm-up operation described above, the release/contact operation for the external heating section 80 is performed after S5. However, the present invention is not just limited to this example. For example, the release/contact operation for the external heating section 80 may be performed after S6, S7, or S8.

Figure 7:
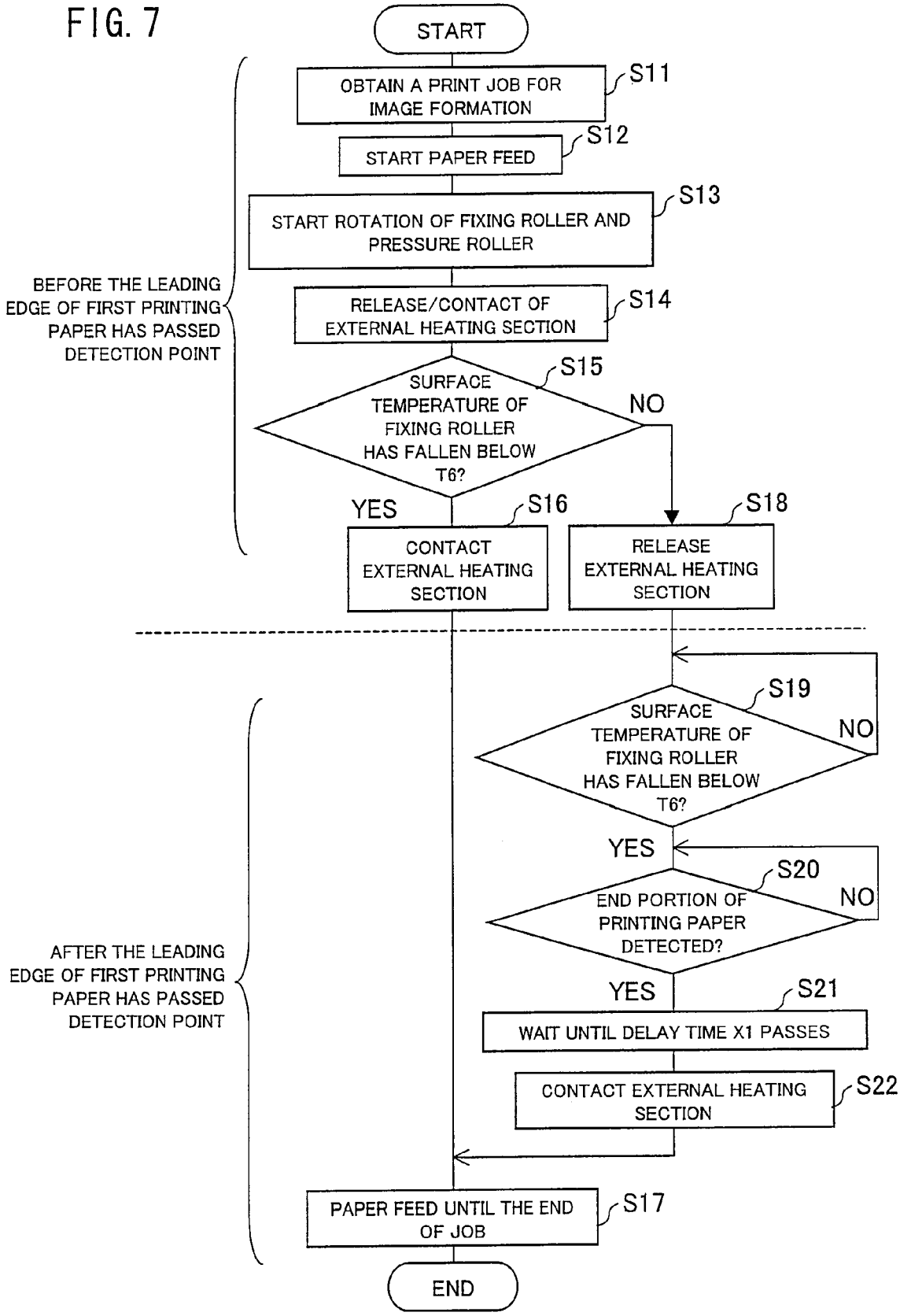
FIG. 7 is a flow chart explaining how the respective components are controlled when a print job for image formation is sent to the image forming apparatus, according to one embodiment of the present invention.

With reference to FIG. 7, the following specifically describes how the respective components are controlled in a fixing process that follows the standby mode after the warm-up operation.

Upon receiving a print job for image formation through pressing of a copy button by a user or an externally transmitted signal for image formation (S11) during the standby mode, the image forming apparatus 1 picks up a printing paper P from the paper feed tray 20 to start paper feed (S12). In response, a print job for a fixing process is sent to the fixing apparatus 40, and the fixing apparatus 40 receives the print job. The control section 90 controls the rotation driving section 91 to start rotating the fixing roller 60 and the pressure roller 70 (S13). Here, it takes at least several seconds for the printing paper P to reach the fixing nip area N of the fixing apparatus 40. Within these seconds, the release/contact operation for the external heating section 80 is performed (S14). As a result, the offset toner on the endless belt 83 is transferred to the fixing roller 60. The offset toner transferred onto the fixing roller 60 passes through the fixing nip area N before the first sheet of printing paper P reaches the fixing nip area N, and is removed by the cleaning section 95 provided downstream of the fixing roller 60, without contaminating the printing paper P.

That is, the control section 90 in S11 instructs the release/contact operating section 110 to bring the external heating section 80 into contact with the fixing roller 60 such that a portion of the fixing roller 60 in contact with the external heating section 80 passes through the fixing nip area N before the first sheet of printing paper P. More specifically, under the control of the control section 90, the release/contact operating section 110 brings the external heating section 80 into contact with the fixing roller 60 at such a timing that a portion of the fixing roller 60 in contact with the external heating section 80 passes through the fixing nip area N before the first sheet of printing paper P.

When there is a long lapse before the printing paper P reaches the fixing nip area N from the receipt of the print job for image formation, the release/contact operation for the external heating section 80 may be performed more than once. In this case, the number of release/contact operations for the external heating section 80 and the contact time are preferably set according to the foregoing conditions described in conjunction with the warm-up operation.

In S15, the control section 90 determines whether the surface temperature of the fixing roller 60, i.e., the temperature detected by the thermistor 65 has reached or fallen below a sixth target temperature T6 (S15). In the present embodiment, the sixth target temperature is 180° C. If it is determined that the temperature detected by the thermistor 65 has reached or fallen below the sixth target temperature T6, the control section 90 controls the release/contact operating section 110 to bring the external heating section 80 into contact with the fixing roller 60 (S16). By bringing the external heating section 80 into contact with the fixing roller 60 in this manner, the temperature of the fixing roller 60 is raised to the target value, before the printing paper P reaches the fixing nip area N.

With the external heating section 80 in contact with the fixing roller 60, a fixing process is performed on the printing paper P at the fixing nip area N, at a suitably controlled temperature of the fixing roller 60 (S17). This is performed until the end of an image-forming job, after which the process is completed.

If it is determined in S16 that the temperature detected by the thermistor 65 has not reached or fallen below the sixth target temperature T6, the control section 90 controls the release/contact operating section 110 to separate the external heating section 80 from the fixing roller 60 (S18). This prevents problems such as high-temperature offset due to excessive heating of the fixing roller 60, or improper stripping of the printing paper P, which might occur when the external heating section 80 is brought into contact with the fixing roller 60 and remains in contact therewith until arrival of the first sheet of printing paper P, or when the external heating section 80 is brought into contact before the temperature of the fixing member falls to a predetermined temperature.

After S18, the fixing apparatus 40 successively performs the fixing process on the printing paper P with the external heating section 80 separated from the fixing roller 60. During this process, the control section 90 obtains a detected temperature from the thermistor 65, and determines whether the surface temperature of the fixing roller 60 has reached or fallen below the sixth target temperature T6 (S19). If it is determined that the temperature detected by the thermistor 65 has not reached or fallen below the sixth target temperature T6, the sequence returns to S19, and the control section 90 keeps monitoring the surface temperature of the fixing roller 60.

If it is determined in S19 that the temperature detected by the thermistor 65 has reached or fallen below the sixth target temperature T6, the surface temperature of the fixing roller 60 needs to be increased by the external heating section 80. Here, when the external heating section 80 is simply brought into contact with the fixing roller 60, there are cases where the offset toner that has accumulated on the endless belt 83 is transferred onto the surface of the fixing roller 60 by the force of impact, with the result that the printing paper P is contaminated with toner as it passes through the fixing nip area N. As a countermeasure, in the present embodiment, the control section 90 controls the contact timing such that the toner contamination that occurs on the fixing roller 60 by the contact with the endless belt 83 takes place between sheets of printing paper P (between sheet A and sheet A+1) at the fixing nip area P. The following specifically describes how the contact timing is adjusted, with reference to FIG. 8.

Figure 8:
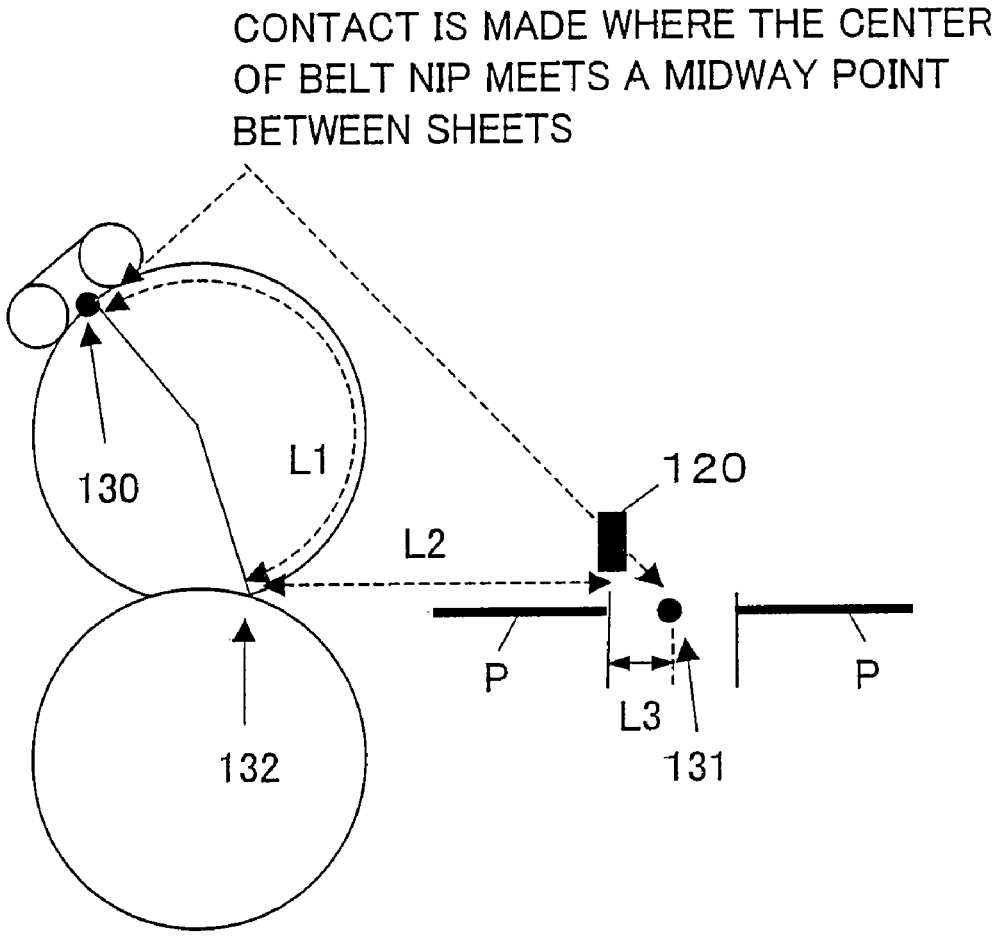
FIG. 8 is a diagram explaining how the contact timing for the external heating section to the fixing roller is adjusted, according to one embodiment of the present invention.
Figure 11:
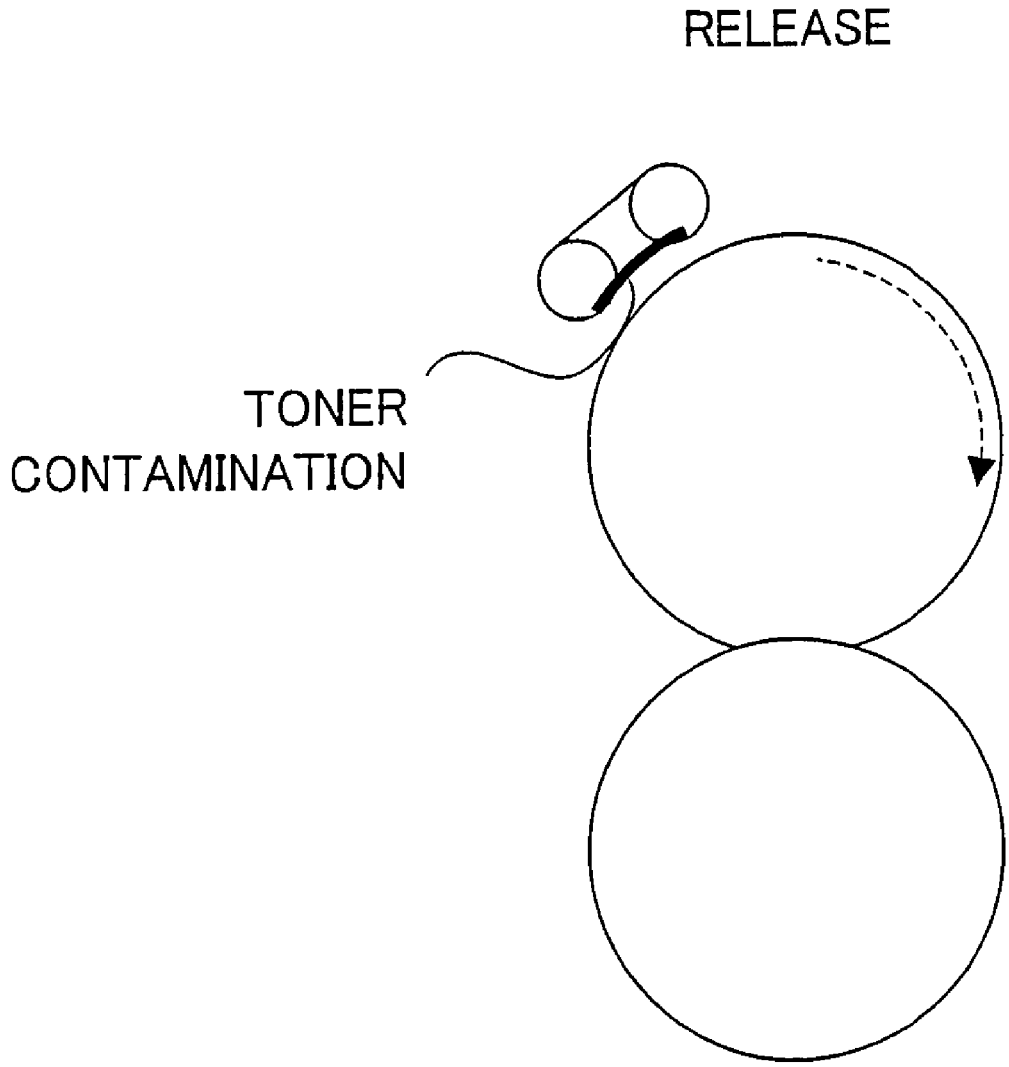
FIG. 11 is a diagram showing how the offset toner that has accumulated on the external heating section contaminates paper, in a state where the external heating section is separated from the fixing roller.
Figure 12:
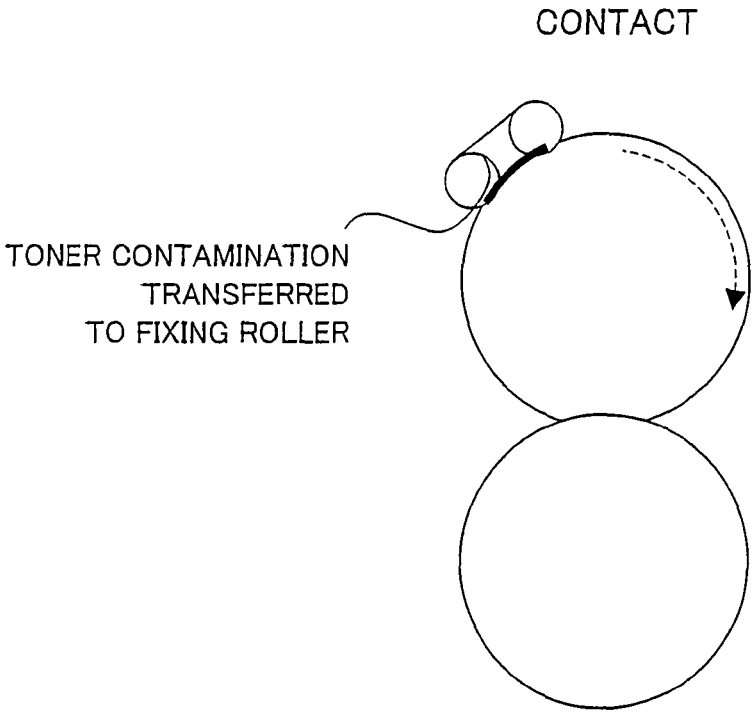
FIG. 12 is a diagram showing how the offset toner that has accumulated on the external heating section contaminates paper, in a state where the external heating section is in contact with the fixing roller, and the offset toner has been transferred to the fixing roller.
Figure 13:
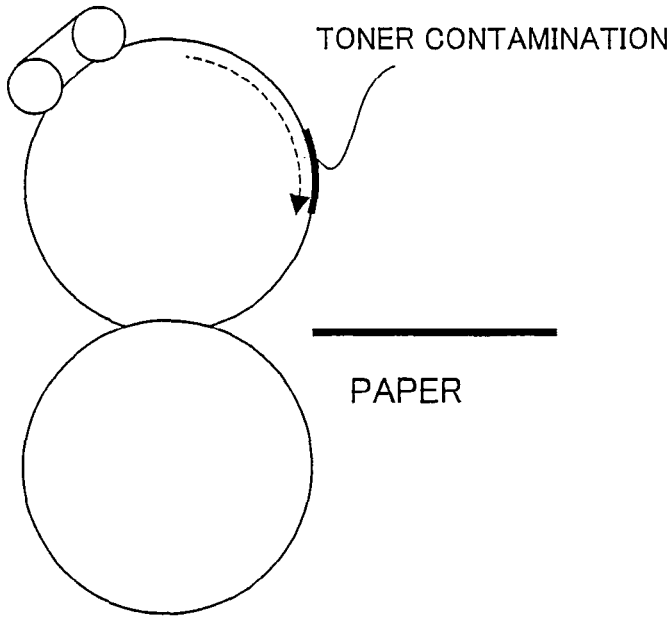
FIG. 13 is a diagram showing how the offset toner that has accumulated on the external heating section contaminates paper, in a state where the offset toner that has been transferred from the external heating section to the fixing roller is being brought to the paper.
Figure 14:
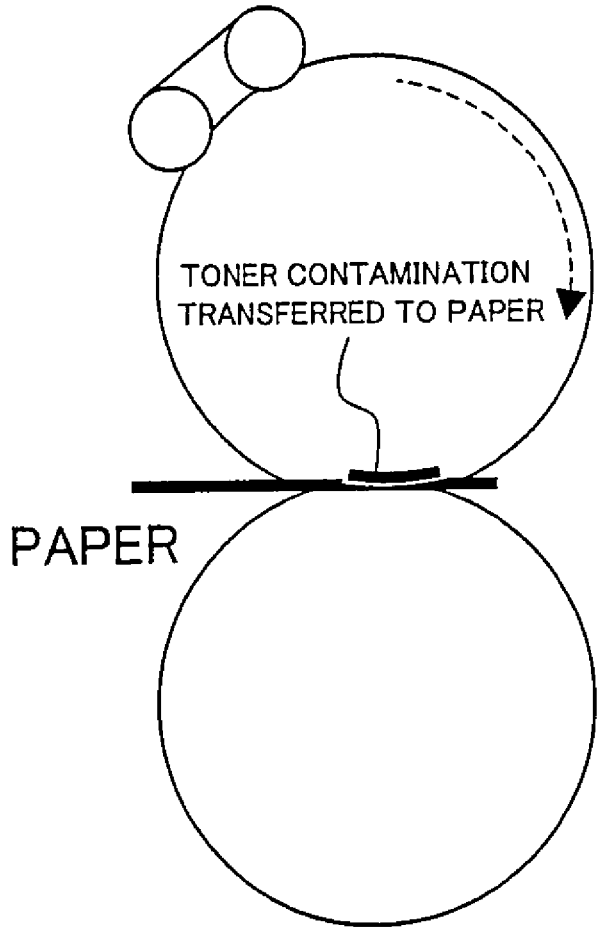
FIG. 14 is a diagram showing how the offset toner that has accumulated on the external heating section contaminates paper, in a state where the offset toner that has been transferred from the external heating section to the fixing roller has adhered to the paper.

As shown in FIG. 8, when the center of the contact portion (initial contact portion) of the external heating section 80 in contact with the fixing member 60 on the endless belt 83 is position 130, and when a midway point between sheets of continuously fed printing paper P is position 131, the control section 90 adjusts the contact timing such that the position 130 and the position 131 meet at the fixing nip area N.

In the present embodiment, the following Formula (4) is satisfied:

$$L1 \leqq L2+L3 \quad (4),$$

where L1 is the periphery length L1 from the position 130 at the center of the initial contact portion on the endless belt 83 in contact with the fixing roller 60 to an upstream end 132 of the fixing nip area N (an end on the upstream side in the direction of rotation of the fixing roller 60), L2 is the transport length from a detection point 133 of printing paper P by the printing paper sensor 120 to the upstream end 132 of the fixing nip area N, and L3 is a half length of the distance between sheets of continuously fed printing paper P, as shown in FIG. 8. It follows from this that the control section 90 instructs the release/contact operating section 110 to bring the external heating section 80 into contact with the fixing roller 60, after a predetermined time X (delay time) has passed from the time when passage of the end portion of the printing paper P is detected by the printing paper sensor 120.

The delay time X can be given by the following Formula (5):

$$X=(L2+L3)/PS-L1/PS-\alpha \quad (5),$$

where PS is the process speed (equal to the rotation speed on the periphery of the fixing roller 60, and the transport speed of printing paper P), and $\alpha$ is the time lag from the contact instruction given to the release/contact operating section 110 by the control section 90, to the actual contact of the external heating section 80.

In the present embodiment, PS=173 mm/s, L1=84.62 mm, L2=180 mm, L3=19.09 mm, $\alpha$=0.275 seconds. This gives a delay time X of 0.386 seconds.

Returning to the flow chart, if it is determined in S19 that the temperature detected by the thermistor 65 has reached or fallen below the sixth target temperature T6, the control section 90 determines whether the printing paper sensor 120 has detected passage of the read end of the printing paper P (S20). If the printing paper sensor 120 has not detected passage of the end portion of the printing paper P, the sequence returns to S20, and the control section 90 keeps monitoring the printing paper sensor 120 until it detects passage of the end portion of the printing paper P.

If it is determined in S20 that the printing paper sensor 120 has detected passage of the end portion of the printing paper P, the control section 90 stands by for the delay time X based on a time count given by a timer (not shown) (S21). When the delay time X has passed, the control section 90 instructs the release/contact operating section 110 to bring the external heating section 80 into contact with the fixing roller 60 (S22).

The sequence then goes to S17, where a fixing process is successively performed on the printing paper P at the fixing nip area N, with the external heating section 80 in contact with the fixing roller 60. This is performed until the end of the image-forming job.

In the foregoing, the release/contact operation enabled for the external heating section 80 to remove offset toner was performed before the first sheet of printing paper P reaches the fixing roller 60. However, the present invention is not limited to such an example. For example, the release/contact operation for the external heating section 80 may be performed after the last sheet of continuously fed printing paper P for continuous image formation has passed the fixing roller 60.

EXAMPLES

In the following, description is made as to experiments that were conducted using the image forming apparatus 1 of the described embodiment. In the Tables summarizing results of experiments, "Excellent" denotes absolutely no toner contamination on printing paper P, "Acceptable" denotes unnoticeable toner contamination with no more than 5 toner clusters on printing paper P, and "Poor" denotes noticeable toner contamination with 6 or greater toner clusters on printing paper P.

(Experiment 1)

An experiment was conducted to access the process in S7 described in the foregoing embodiment, i.e., the effect of repeating the release/contact operation for the external heating section 80 during warm-up.

First, the image forming apparatus 1 was placed under a heavy load of image forming process in an intermittent mode, in order to accumulate offset toner on the endless belt 83. Specifically, a cycle of feeding 50 sheets of paper (followed by image formation) and 10 seconds of arrest was repeated 100 times. The image forming apparatus 1 was then turned off, and the respective components of the fixing apparatus 40 were allowed to cool to room temperature. This was followed by a warm-up operation. In this experiment, assessment was made as to levels of toner contamination on the printing paper P in an image forming process that was performed following the warm-up. The assessment was made by comparing Example 1 in which the release/contact operation described in the foregoing embodiment was repeated 5 times during warm-up, and Comparative Example 1 in which no release/contact operation was performed.

After the warm-up, the image forming apparatus 1 was brought to a standby mode, and feeding was started with the external heating section 80 separated from the fixing roller 60. The external heating section 80 was brought into contact with the fixing roller 60 during feeding. Here, the contact timing for the external heating section 80 was adjusted such that the initial contact portion with the fixing roller 60 lay on top of the printing paper P at the fixing nip area N in one rotation of the fixing roller 60.

The results are shown in Table 1. In Example 1 in which the release/contact operation was repeated during warm-up, no toner contamination occurred on printing paper P, whereas toner contamination was observed on printing paper P in Comparative Example 1 in which no release/contact operation was performed.

TABLE 1

| | Example 1 | Comparative Example 1 |
|---|---|---|
| Contamination | Excellent | Poor |

(Experiment 2)

An experiment was conducted to access the processes in S20 to S22 described in the foregoing embodiment, i.e., the effect of adjusting the contact timing for the external heating section 80 during a continuous paper feed.

First, as in Experiment 1, the image forming apparatus 1 was placed under a heavy load of image forming process in an intermittent mode, in order to accumulate offset toner on the endless belt 83. After resuming the feeding operation, the external heating section 80 was brought into contact with the fixing roller 60. In this experiment, assessment was made as to levels of toner contamination on the printing paper P in an image forming process that was performed immediately following the contact with the external heating section 80. The assessment was made by comparing Example 2 in which the contact timing for the external heating section 80 was adjusted such that the initial contact portion with the fixing roller 60 lay not on top of the printing paper P but on a midway point between sheets of printing paper P at the fixing nip area N in one rotation of the fixing roller 60, and Comparative Example 2 in which the contact timing was adjusted such that the initial contact portion with the fixing roller 60 lay on top of the printing paper P at the fixing nip area N in one rotation of the fixing roller 60.

The results are shown in Table 2. In Example 2 in which the contact timing was adjusted such that the contact portion with the fixing roller 60 lay between sheets of printing paper P, there was only an unnoticeable level of toner contamination on printing paper P, whereas toner contamination was clearly visible on the printing paper P in Comparative Example 2 in which the contact timing was adjusted such that the contact portion with the fixing roller 60 lay on top of the printing paper P at the fixing nip area N.

TABLE 2

| | Example 2 | Comparative Example 2 |
|---|---|---|
| Contamination | Acceptable | Poor |

(Experiment 3)

An experiment was conducted to access the process in S14 described in the foregoing embodiment, i.e., the effect of release/contact operation for the external heating section 80 performed after a print job for image formation has been made and before the first sheet of printing paper P has been transported to the fixing roller 60.

First, as in Experiment 1, the image forming apparatus 1 was placed under a heavy load of image forming process in an intermittent mode, in order to accumulate offset toner on the endless belt 83. Feeding was resumed after this procedure. In this experiment, assessment was made as to levels of toner contamination on the printing paper P in an image forming process that was performed immediately following the contact with the external heating section 80. The assessment was made by comparing Example 3 in which the external heating section 80 was separated after a singe round of release/contact operation for the external heating section 80, which was performed before the leading edge of the first sheet of printing paper P had reached the fixing roller 60, and Comparative Example 3 in which the release/contact operation for the external heating section 80 was not performed until the leading edge of the first sheet of printing paper P had reached the fixing roller 60.

Specifically, the external heating section 80 was brought into contact with the fixing roller 60 at an appropriate timing during a continuous paper feed, after the first sheet of printing paper P had reached the fixing roller 60. Here, the contact timing for the external heating section 80 was adjusted such that the initial contact portion with the fixing roller 60 lay on top of the printing paper P at the fixing nip area N in one rotation of the fixing roller 60.

The results are shown in Table 3. In Example 3 in which the release/contact operation for the external heating section 80 was performed before the leading edge first sheet of printing paper P had reached the fixing roller 60, there was only an unnoticeable level of toner contamination on the printing paper P, whereas toner contamination was clearly visible on the printing paper P in Comparative Example 3 in which the release/contact operation for the external heating section 80 was not performed until the leading edge of the first sheet of printing paper P had reached the fixing roller 60.

TABLE 3

| | Example 3 | Comparative Example 3 |
|---|---|---|
| Contamination | Acceptable | Poor |

(Experiment 4)

An experiment was conducted to access the combined effects of the foregoing factors described in Examples 1 to 3. Specifically, assessment was made as to improvement in preventing toner contamination on printing paper P, by comparing Example 4 (combining Examples 1 and 2), Example 5 (combining Examples 2 and 3), Example 6 (combining Examples 1 and 3), and Example 7 (combining all of Examples 1 to 3).

The results are shown in Table 4. There was improvement in preventing toner contamination on the printing paper P in all of the examples.

TABLE 4

| | Example 4 (Examples 1 + 3) | Example 5 (Examples 2 + 3) | Example 6 (Examples 1 + 3) | Example 7 (Examples 1 to 3) |
|---|---|---|---|---|
| Contamination | Excellent | Excellent | Excellent | Excellent |

The results of experiment show that toner contamination can be sufficiently prevented by combining the release/contact operations that are performed during warm-up and before the arrival of the first sheet of printing paper P, even in situations where control of the contact timing for the external heating section 80 during a continuous paper feed is difficult due to a fast processing speed, which affords only a short distance between sheets of printing paper P relative to the contact width (20 mm) between the endless belt 83 and the fixing roller 60.

The present invention prevents contamination of printing medium such as printing paper caused by toner that has been transferred from the external heating member to the fixing roller in a fixing apparatus in which the external heating member is installed. The invention is therefore suitable for various types of electrophotographic image forming apparatuses, such as copying machines, printers, and facsimile machines.

The present invention is not limited to the description of the embodiment and examples above, but may be altered by a skilled person within the scope of the claims. An embodiment based on a proper combination of technical means disclosed in different embodiments is encompassed in the technical scope of the present invention.

It should also be appreciated that the numerical ranges specified in the foregoing embodiment and examples do not limit the present invention in any way, and values falling outside of the specified ranges also fall within the scope of the present invention so long as the values are reasonable in view of the gist of the present invention.

As described above, a fixing apparatus according to the present invention includes: a fixing member, pressed against a printing medium at a nip area, for fixing a developer on the printing medium, and transporting the printing medium by undergoing rotation; an external heating member for heating a surface of the fixing member by being brought into contact therewith; a release/contact operating section for causing the external heating member to be brought into contact with or separated from the fixing member; a cleaning section for removing the developer from the surface of the fixing member; and a control section for controlling the release/contact operating section, so as to bring the external heating member into contact with the fixing member at such a timing that a portion of the fixing member initially in contact with the external heating member does not make contact with the printing medium in one rotation of the fixing member.

In a fixing apparatus according to the present invention, the external heating member is brought into contact with the fixing member at such a timing that the portion of the fixing member initially in contact with the external heating member does not make contact with the printing medium in one rotation of the fixing member. The printing medium is therefore prevented from being contaminated by the developer that has been transferred from the external heating member to the fixing member.

For example, the external heating member is brought into contact with the fixing member at the following timing. Under the control of the control section, the release/contact operating section brings the external heating member into contact with the fixing member at such a timing that a portion of the fixing member initially in contact with the external heating member lies between printing media when the initial contact portion first reaches the nip area by the rotation of the fixing member.

According to the foregoing arrangement, the developer that has been transferred from the external heating member to the fixing member at the initial contact portion lies between printing media at the nip area. Thus, the developer that has been transferred from the external heating member to the fixing member does not adhere to the printing medium.

The fixing apparatus having the foregoing arrangement is preferably provided with a printing medium detecting section, provided upstream of the fixing member in a direction of transport of the printing medium by the fixing member, for detecting passage of the printing medium and outputting a detection signal, wherein the control section determines the contact timing based on a result of detection by the printing medium detecting section.

According to the foregoing arrangement, by the provision of the printing medium detecting section that detects passage of the printing medium, the time at which the interspace between printing media reaches the nip area can be accurately predicted. This enables the contact timing for the external heating section to be accurately adjusted.

The fixing apparatus preferably includes a temperature detecting section for detecting a surface temperature of the fixing member, wherein, when the temperature detected by the temperature detecting section is below a predetermined temperature, the release/contact operating section, under the control of the control section, brings the external heating member into contact with the fixing member at such a timing that the initial contact portion lie between printing media when the initial contact portion first reaches the nip area by the rotation of the fixing member.

According to the foregoing arrangement, the external heating member is brought into contact with the fixing member when the surface temperature of the fixing member is below a predetermined temperature. This prevents high-temperature offset caused by overheating of the fixing member. Improper stripping of the printing medium is also prevented.

The external heating member may also be brought into contact with the fixing member at the following timing, for example. Under the control of the control section, the release/contact operating section brings the external heating member into contact with the fixing member at such a timing that, after the fixing member has received a print job for starting a fixing process, the initial contact portion completely passes through an upstream end of the nip area before a leading edge of a first sheet of printing medium reaches the upstream end of the nip area.

According to the foregoing arrangement, the developer that has been transferred from the external heating member to the fixing member at the initial contact portion completely passes through the nip area before the first sheet of printing medium reaches the nip area. Thus, the developer that has been transferred from the external heating member to the fixing member does not adhere to the printing medium.

In the fixing apparatus having the foregoing arrangement, it is preferable that, under the control of the control section, the release/contact operating section first brings the external heating member into contact with the fixing member, and then separates the external heating member therefrom before the leading edge of the first sheet of printing medium reaches the upstream end of the nip area.

If the external heating member were brought into contact with the fixing member and kept contact therewith until the first sheet of printing medium reaches the nip area, the external heating member overheats the fixing member. This may cause problems such as high-temperature offset or improper stripping of the printing medium in the subsequent fixing process. According to the foregoing arrangement, however, the external heating member is separated from the fixing member before the first sheet of printing medium reaches the nip area. This prevents high-temperature offset caused by overheating of the fixing member. Improper stripping of the printing medium is also prevented.

The external heating member may also be brought into contact with the fixing member at the following timing, for example. Under the control of the control section, the release/contact operating section brings the external heating member into contact with the fixing member during warm-up of the fixing member or after a fixing process by the fixing member is completed.

According to the foregoing arrangement, the transfer of the developer from the external heating member to the fixing member occurs during warm-up or after the fixing process is completed. Since the printing medium is not transported to the nip area of the fixing member during these time periods, the developer that has been transferred from the external heating member to the fixing member does not adhere to the printing medium.

In the fixing apparatus having the foregoing arrangement, it is preferable that the external heating member be driven by the rotation of the fixing member when in contact with the fixing member, that the fixing apparatus further include a rotation driving section for rotating the fixing member under control of the control section, and that, during warm-up of the fixing roller or after a fixing process by the fixing member is completed, the control section control the rotation driving section to rotate the fixing member, and control the release/contact operating section to repeat the release and contact of the external heating member with respect to the fixing member.

According to the foregoing arrangement, the external heating member is driven by the rotation of the fixing member, and the developer adheres to the surface of the external heating member and accumulates thereon over the entire periphery. Here, a single impact of the external heating member with the fixing member is not enough to cover all regions of the external heating member with the fixing member. According to the foregoing arrangement, the external heating member is brought into contact with the fixing member more than once. When in contact with the external heating member, the fixing member is rotated by the rotation driving section, which in turn rotates the external heating member. That is, the external heating member is brought into contact with the fixing member more than once while undergoing rotation, and therefore the developer that has accumulated on the external heating member can be removed over a wide area.

In the fixing apparatus having the foregoing arrangement, it is preferable that, under the control of the control section, the release/contact operating section repeats the release and contact of the external heating member N times with respect to the fixing member, wherein N satisfies $$N \geqq \mathrm{Lex}/Ln,$$

where Lex is a periphery length of the external heating member, and Ln is a periphery length of the contact portion, which is an area of contact between the fixing member and the external heating member.

As defined above, when the contact is made once, the external heating member is in contact with the fixing member over the length Ln in the entire periphery length Lex of the external heating member. As such, the developer is removed from the area with length Ln. It follows from this that when the external heating member is brought into contact with the fixing member N times, the developer is removed from the area with a length defined by Ln×N. According to the foregoing arrangement, N is set such that the length Ln×N of the area from which the developer is removed by the contact is equal to or greater than the periphery length Lex. In this way, the developer that has accumulated on the external heating member can be removed over the entire periphery.

In the fixing apparatus having the foregoing arrangement, it is preferable that, under the control of the control section, the release/contact operating section brings the external heating member into contact with the fixing member for time t in each release and contact of the external heating member with respect to the fixing member, wherein t satisfies $$\mathrm{Lex} \times A/V < t \leqq (Ln + \mathrm{Lex} \times A)/V, \text{ and}$$

$$N \geqq \mathrm{Lex}/(V \times t - \mathrm{Lex} \times A),$$

where V is a rotation speed on the surface of the fixing member in contact with the external heating member, and A is a natural number.

As defined above, the external heating member rotates over a distance t×V for each contact. The amount of misalignment (length) that occurs by the rotation of the external heating member for each contact is t×V−Lex×A. Here, A denotes the number of rotations of the external heating member for each contact. According to the foregoing arrangement, the contact time t is set such that t×V−Lex×A is greater than 0 and no greater than Ln. As such, even in situations where the endless belt 83 is driven to undergo more than one rotation for each contact, there will be no gap on the periphery of the external heating member, between a region that is made contact in the nth rotation and a region that is made contact in the (n+1)th rotation. This enables the toner from being removed without leaving any space on the periphery of the external heating member, from the upstream to downstream end in the direction of rotation of the external heating member.

As defined above, when made contact N times, the external heating member is in contact with the fixing member over a total length (t×V−Lex×A)×N. According to the foregoing arrangement, the contact time t is set such that the (t×V−Lex×A)×N is equal to or greater than the periphery length Lex. Thus, even in situations where the endless belt is driven to undergo more than one rotation for each contact, the external heating member is in contact with the fixing member over a total length that is equal to or greater than the periphery length of the external heating member. This enables the developer to be removed over the entire periphery of the external heating member.

It is preferable that the external heating member include a belt member that is made contact with the fixing member.

By the provision of the belt member for the external heating member, it is possible to provide a wide contact portion, i.e., a heating nip area, between the external heating member and the fixing member. This enables the fixing member to be heated uniformly. Meanwhile, a drawback of the external heating member with a belt member is that, due to the wide heating nip area as compared with the heating nip area in the roller-type external heating member, the contamination on the external heating member is easily transferred to the fixing member to contaminate the printing medium. With the foregoing arrangement, a fixing apparatus according to the present invention can prevent such contamination of the printing medium even with the use of the external heating section having the foregoing arrangement.

An image forming apparatus according to the present invention includes the fixing apparatus.

According to the foregoing arrangement, by the provision of the fixing apparatus, the image forming apparatus can form quality images with no defects, without having the printing medium contaminated during the fixing process, which is caused by the developer, such as toner, that has been transferred from the external heating member to a fixing member such as a fixing roller.

The embodiments and concrete examples of implementation discussed in the foregoing detailed explanation serve solely to illustrate the technical details of the present invention, which should not be narrowly interpreted within the limits of such embodiments and concrete examples, but rather may be applied in many variations within the spirit of the present invention, provided such variations do not exceed the scope of the patent claims set forth below.

What is claimed is:

1. A fixing apparatus comprising:

a fixing member, pressed against a printing medium at a nip area, for fixing a developer on the printing medium, and transporting the printing medium by undergoing rotation;

an external heating member for heating a surface of the fixing member by being brought into contact therewith;

a release/contact operating section for causing the external heating member to be brought into contact with or separated from the fixing member;

a cleaning section for removing the developer from the surface of the fixing member; and a control section for controlling the release/contact operating section, so as to bring the external heating member into contact with the fixing member at such a timing that a portion of the fixing member initially in contact with the external heating member does not make contact with the printing medium in one rotation of the fixing member.

2. The fixing apparatus as set forth in claim 1, wherein the control section controls the release/contact operating section so that the external heating member is brought into contact with the fixing member at such a timing that the initial contact portion lies between printing media when the initial contact portion first reaches the nip area by the rotation of the fixing member.

3. The fixing apparatus as set forth in claim 2, comprising a printing medium detecting section, provided upstream of the fixing member in a direction of transport of the printing medium by the fixing member, for detecting passage of the printing medium and outputting a detection signal, wherein the control section determines the contact timing based on a result of detection by the printing medium detecting section.

4. The fixing apparatus as set forth in claim 2, comprising a temperature detecting section for detecting a surface temperature of the fixing member, wherein, when the temperature detected by the temperature detecting section is below a predetermined temperature, the control section controls the release/contact operating section so that the external heating member is brought into contact with the fixing member at such a timing that the initial contact portion lies between printing media when the initial contact portion first reaches the nip area by the rotation of the fixing member.

5. The fixing apparatus as set forth in claim 1, wherein the control section controls the release/contact operating section so that the external heating member is brought into contact with the fixing member at such a timing that, after the fixing member has received a print job for starting a fixing process, the initial contact portion completely passes through an upstream end of the nip area before a leading edge of a first sheet of printing medium reaches the upstream end of the nip area.

6. The fixing apparatus as set forth in claim 5, wherein the control section controls the release/contact operating section so that the external heating member is first brought into contact with the fixing member, and then separated therefrom before the leading edge of the first sheet of printing medium reaches the upstream end of the nip area.

7. The fixing apparatus as set forth in claim 1, wherein the control section controls the release/contact operating section so that the external heating member is brought into contact with the fixing member during warm-up of the fixing member or after a fixing process by the fixing member is completed.

8. The fixing apparatus as set forth in claim 7, wherein the external heating member is driven by the rotation of the fixing member when in contact with the fixing member, said fixing apparatus further comprising a rotation driving section for rotating the fixing member under control of the control section, wherein, during warm-up of the fixing member or after a fixing process by the fixing member is completed, the control section controls the rotation driving section to rotate the fixing member, and controls the release/contact operating section to repeat the release and contact of the external heating member with respect to the fixing member.

9. The fixing apparatus as set forth in claim 8, wherein the control section controls the release/contact operating section so that the release and contact of the external heating member with respect to the fixing member is repeated N times, wherein N satisfies $$N \geqq \mathrm{Lex}/Ln,$$

where Lex is a periphery length of the external heating member, and Ln is a periphery length of the contact portion, which is an area of contact between the fixing member and the external heating member.

10. The fixing apparatus as set forth in claim 9, wherein the control section controls the release/contact operating section so that the external heating member is brought into contact with the fixing member for time t in each release and contact of the external heating member with respect to the fixing member, wherein t satisfies $$\mathrm{Lex} \times A/V < t \leqq (Ln + \mathrm{Lex} \times A)/V, \text{ and}$$

$$N \geqq \mathrm{Lex}/(V \times t - \mathrm{Lex} \times A),$$

where V is a rotation speed on the surface of the fixing member in contact with the external heating member, and A is a natural number.

11. The fixing apparatus as set forth in claim 1, wherein external heating member includes a belt member that is made contact with the fixing member.

12. An image forming apparatus comprising a fixing apparatus that includes:

a fixing member, pressed against a printing medium at a nip area, for fixing a developer on the printing medium, and transporting the printing medium by undergoing rotation;

an external heating member for heating a surface of the fixing member by being brought into contact therewith;

a release/contact operating section for causing the external heating member to be brought into contact with or separated from the fixing member;

a cleaning section for removing the developer from the surface of the fixing member; and a control section for controlling the release/contact operating section, so as to bring the external heating member into contact with the fixing member at such a timing that a portion of the fixing member initially in contact with the external heating member does not make contact with the printing medium in one rotation of the fixing member.

13. A non-transitory computer-readable storage medium storing a control program for a fixing apparatus that includes:

a fixing member, pressed against a printing medium at a nip area, for fixing a developer on the printing medium, and transporting the printing medium by undergoing rotation;

an external heating member for heating a surface of the fixing member by being brought into contact therewith;

a release/contact operating section for causing the external heating member to be brought into contact with or separated from the fixing member;

a cleaning section for removing the developer from the surface of the fixing member; and a control section for controlling the release/contact operating section, so as to bring the external heating member into contact with the fixing member at such a timing that a portion of the fixing member initially in contact with the external heating member does not make contact with the printing medium in one rotation of the fixing member, said control program causing a computer to operate as the control section of the fixing apparatus.

14. A method for causing an external heating member to be brought into contact with a fixing member in a fixing apparatus that includes:

a fixing member, pressed against a printing medium at a nip area, for fixing a developer on the printing medium, and transporting the printing medium by undergoing rotation;

an external heating member for heating a surface of the fixing member by being brought into contact therewith; and a cleaning section for removing the developer from the surface of the fixing member, said method comprising bringing the external heating member into contact with the fixing member at such a timing that a portion of the fixing member initially in contact with the external heating member does not make contact with the printing medium in one rotation of the fixing member.

* * * * *